US011033800B2

(12) United States Patent
Sullivan

(10) Patent No.: US 11,033,800 B2
(45) Date of Patent: Jun. 15, 2021

(54) BOARD APPARATUS WITH A PIVOT WHEEL FOR TRAVERSING INCLINES

(71) Applicant: Hill Glider Inc., Ottawa (CA)

(72) Inventor: William Paul Sullivan, Almonte (CA)

(73) Assignee: HILL GLIDER INC., Ottawa (CA)

( * ) Notice: Subject to any disclaimer, the term of this patent is extended or adjusted under 35 U.S.C. 154(b) by 0 days.

(21) Appl. No.: 16/004,146

(22) Filed: Jun. 8, 2018

(65) Prior Publication Data

US 2019/0015729 A1 Jan. 17, 2019

Related U.S. Application Data

(63) Continuation of application No. PCT/CA2016/000280, filed on Nov. 17, 2016.

(60) Provisional application No. 62/264,423, filed on Dec. 8, 2015.

(51) Int. Cl.

| | |
|---|---|
| ***A63C 17/01*** | (2006.01) |
| ***A63C 17/14*** | (2006.01) |
| ***A63C 17/26*** | (2006.01) |
| ***A63C 17/00*** | (2006.01) |

(52) U.S. Cl.

CPC ..... *A63C 17/014* (2013.01); *A63C 17/006* (2013.01); *A63C 17/1427* (2013.01); *A63C 17/262* (2013.01); *A63C 2017/1472* (2013.01)

(58) Field of Classification Search

CPC .. A63C 1/02; A63C 1/00; A63C 1/015; A63C 1/014; A63C 1/017; A63C 1/0073

See application file for complete search history.

(56) References Cited

U.S. PATENT DOCUMENTS

| | | | | |
|---|---|---|---|---|
| 4,073,356 | A | 2/1978 | Schlicht | |
| 7,172,044 | B2 * | 2/2007 | Bouvet | A63C 17/12 180/15 |
| 8,398,099 | B2 * | 3/2013 | Edginton | A63C 5/035 280/841 |
| 8,579,306 | B2 * | 11/2013 | Lewis | A63C 17/16 280/87.042 |

(Continued)

FOREIGN PATENT DOCUMENTS

| | | | |
|---|---|---|---|
| GB | 2345561 | A | 8/2000 |
| WO | WO-2004/098730 | A1 | 11/2004 |

(Continued)

*Primary Examiner* — John D Walters
*Assistant Examiner* — James J Triggs
(74) *Attorney, Agent, or Firm* — Sean Murray; Murray IP Consulting Inc

(57) ABSTRACT

A board apparatus that a user can ride and use to traverse inclines is disclosed. The board apparatus comprises an elongated board with a pivot wheel protruding through the board. A user of the board apparatus can stand on the board with feet in front and behind the pivot wheel, balancing a substantial portion of their weight on the pivot wheel. By adjusting their weight on the pivot wheel, the user is able to control the board's direction of travel. The board apparatus may further comprise a brake apparatus integrated to the pivot wheel that allows the user to maintain control over their speed as the board apparatus gains momentum going down an incline. The board apparatus may further comprise low friction elements at their front and/or rear ends to assist in maintaining momentum if the front or rear end comes into contact with the ground or an obstacle.

18 Claims, 21 Drawing Sheets

(56) References Cited

U.S. PATENT DOCUMENTS

| | | | | |
|---|---|---|---|---|
| 9,999,827 | B2 * | 6/2018 | Wood | A63C 17/12 |
| 2002/0043777 | A1 * | 4/2002 | Ireton | A63C 17/1427 280/87.042 |
| 2002/0171217 | A1 | 11/2002 | Sutherland | |
| 2003/0155733 | A1 * | 8/2003 | Tan | A63C 17/01 280/87.042 |
| 2012/0193884 | A1 | 8/2012 | Scolari | |
| 2013/0049317 | A1 | 2/2013 | Cheek | |
| 2014/0312582 | A1 | 10/2014 | Scolari | |
| 2016/0129743 | A1 | 5/2016 | DeFerrari | |

FOREIGN PATENT DOCUMENTS

| | | | |
|---|---|---|---|
| WO | WO-2007/059553 | A1 | 5/2007 |
| WO | WO-2014/147752 | A1 | 9/2014 |
| WO | WO-2017/096463 | A1 | 6/2017 |

* cited by examiner

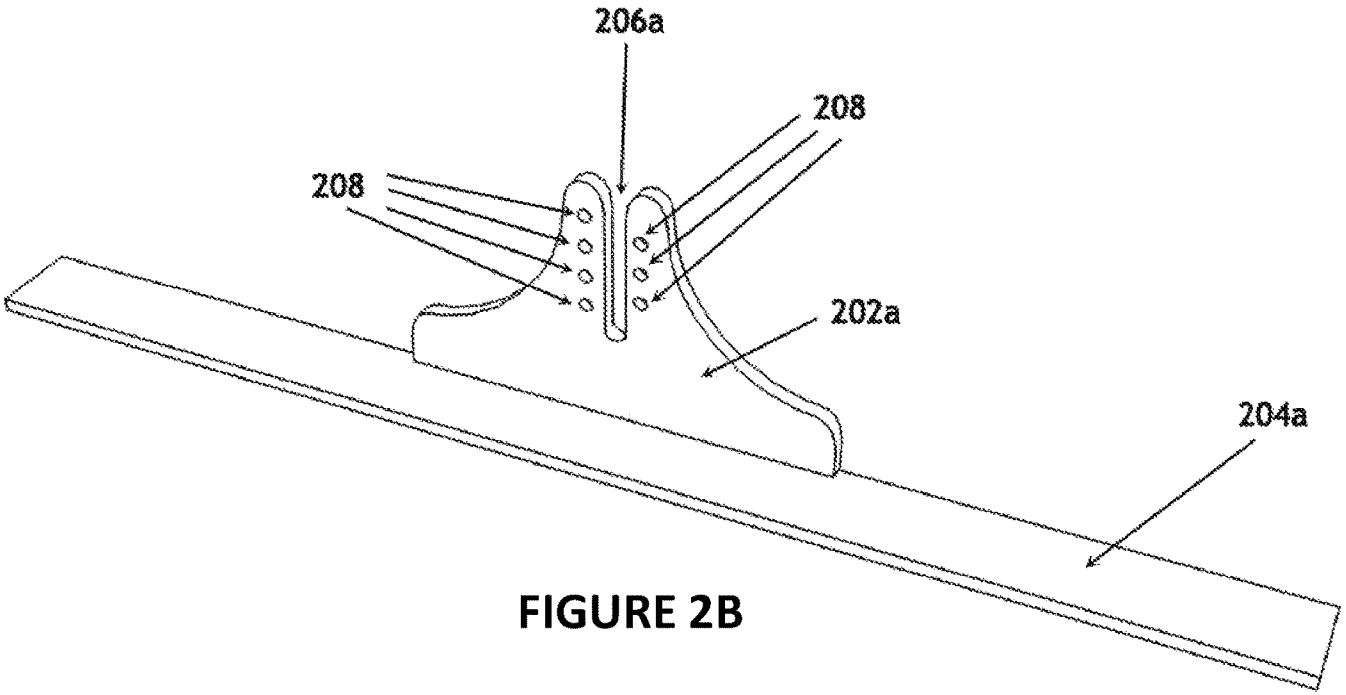
FIGURE 2B
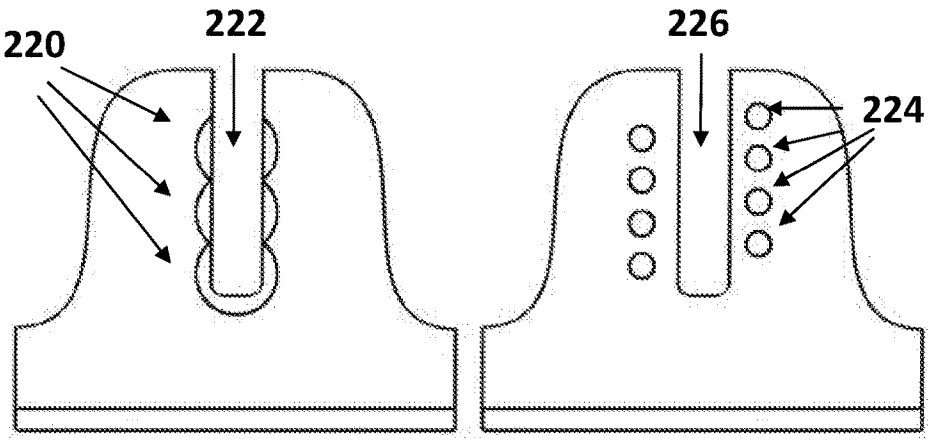
FIGURE 2C
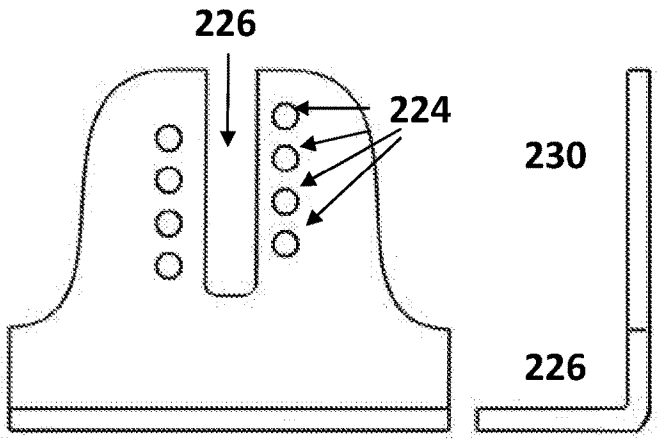
FIGURE 2D
FIGURE 2E
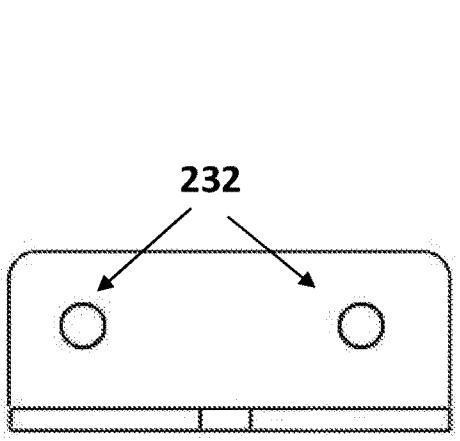
FIGURE 2F

BOARD APPARATUS WITH A PIVOT WHEEL FOR TRAVERSING INCLINES

CROSS-REFERENCE TO RELATED APPLICATION

The present application claims the benefit under 35 USC 120 as a continuation of PCT Patent Application Serial No. PCT/CA2016/000280, filed on Nov. 17, 2016 entitled "BOARD APPARATUS WITH A PIVOT WHEEL FOR TRAVERSING INCLINES" by William Paul SULLIVAN, hereby incorporated by reference herein, which in turn claims the benefit under 35 USC 119(e) of U.S. Provisional Patent Application 62/264,423, filed on Dec. 8, 2015 and hereby incorporated by reference herein.

FIELD OF THE INVENTION

The invention relates generally to board apparatus and, more particularly, to board apparatus with a pivot wheel for traversing inclines.

BACKGROUND

Skateboards were first developed in the 1940s and today typically consist of an elongated oval board with smooth corners and four small wheels affixed on the corners below the board. They are generally used for recreational activities and as a means of transportation in urban areas. A user of a skateboard can create forward motion by pushing with one foot while maintaining contact on the top of the board with the second foot. The user can then ride the skateboard with both feet on the board and glide until another push is required to keep the forward motion. A user of a skateboard may also gain forward momentum by going down inclines and allowing gravity to apply to the skateboard and the user on the skateboard.

Traditional skateboards require a smooth hard surface to reduce the friction and allow for less energy to be exerted in order to keep forward motion to continue. In urban environments, skateboards are often used on pavement such as roads and sidewalks, as well as dedicated recreational parks made of pavement. Users of skateboards can reduce their speeds in a number of ways including putting their foot down and creating friction between the foot and ground or by using a rear braking pad typically implemented under the board at the rear end. By pushing the rear of the board downward and raising the front of the board, the user can initiate contact between the rear brake pad and the ground, thus causing friction which will result in a reduction in speed.

Skateboards are not typically designed to operate well on uneven or soft ground or ground covered in grass, rocks or other obstacles. The small wheels implemented on standard skateboards are easily interfered with and jammed or otherwise obstructed. To allow for the activity of riding a board in non-ideal environments such as grassy hills, one approach has been to increase the size of the wheels and to affix the wheels at the corners of the board on the outside of the board. This type of board is commonly called a mountain board and allows a user to use a skateboard-type apparatus on uneven environments such as a grassy field or surfaces with rocks. As indicated in the name, mountain boards are often used to allow a user to skateboard down a significant incline and use the larger wheels to overcome the obstacles such as grass or rocks.

To decrease speed or control their decline, a user of a mountain board will typically use one of their feet to create friction with the ground. Alternatively, similar to a standard skateboard, a user of a mountain board may also push downwards on the rear of the board and create friction between a rear brake pad and the ground. These methods of controlling speed on a mountain board are not always particularly effective, especially in cases where the downward incline is significant and the speeds achieved with the mountain board are high. Further, changing directions significantly with a mountain board is difficult, requiring dramatic jumps in the air during which control is minimal and there are serious risks during landing. The use of mountain boards to "skateboard" on hills and mountains is considered an extreme sport due to the limited amount of control that the participants have over the speed and direction of travel. Further, although the wheels are larger than typical skateboard wheels and the wheels are not affixed under the board, obstructions causing a jammed wheel can still be an issue, thus potentially causing a board to abruptly stop which could cause significant injury to the user.

Another approach to taking the sensation of skateboarding to hills and mountains has been the highly successful development of snowboards. Snowboards are rectangular boards with curved corners and no wheels which are designed to ride smoothly over snow. A user has their feet strapped onto the top of the board and can adjust their weight on the board to control direction and speed of the board. When on a downward incline, a user of a snowboard can direct their weight to the rear of the board and adjust pressure on either side of the board to allow the edges of the board to cut into the snow underneath and control sweeping turns while declining down a hill. Although somewhat similar to skateboarding, the sensation of snowboarding is often more associated with surfing in which a user uses an elongated board to ride waves in oceans and other bodies of water. The user of a snowboard can enjoy a controlled decline down a hill if the snow conditions are correct and the user knows how to control the speed and direction of travel of the board using edging.

Of course, snowboards are only effective when there is significant snow on the hill or mountain to reduce the friction on the board and allow the user of the snowboard to gain speed on the decline and control the descent by applying pressure on the edges of the board. Any attempt to use a snowboard on a surface with higher friction coefficients to snow such as grass, dirt or pavement or surfaces with obstructions such as rocks or sticks would result in less than ideal outcomes and could lead to less enjoyment, damage to the snowboard and/or injury to the user.

Against this background, there is a need for solutions that will mitigate at least one of the above problems, particularly enabling a user to safely ride on a board in a variety of incline environments for enjoyment and/or transportation.

SUMMARY OF THE INVENTION

In various embodiments of the present invention, a board apparatus comprises an elongated board with a pivot wheel protruding through the board such that the pivot wheel is adapted to rotate in parallel with the length of the board. A user of the board apparatus can stand on the board with feet in front and behind the pivot wheel, balancing a substantial portion of their weight on the pivot wheel. By adjusting their weight on the pivot wheel, the user is able to control the board's direction of travel. The board apparatus may further comprise a brake apparatus integrated to the pivot wheel to allow the user to maintain control over their speed as the board apparatus gains momentum going down an incline. The board apparatus may further comprise low friction elements at their front and/or rear ends to assist in maintaining momentum if the front or rear end comes into contact with the ground or an obstacle.

According to a first broad aspect, the present invention is an apparatus comprising: an elongated board, a pivot wheel and a brake apparatus coupled to the pivot wheel. The board is adapted for a user to stand on, the board having a length with first and second ends and a hole at a pivot location between the first and second ends. The pivot wheel is coupled to the board and protruding through the hole such that the pivot wheel is adapted to rotate in parallel with the length of the board, a first portion of the pivot wheel being below the board and a second portion of the pivot wheel being above the board.

In some embodiments, the hole is substantially centered between the first and second ends. In some implementations, the pivot wheel may comprise a central axle and the apparatus may further comprise a wheel mounting apparatus coupled to the board adjacent to the hole at the pivot location, the wheel mounting apparatus being adapted to secure the axle of the pivot wheel above a top surface of the board. The wheel mounting apparatus may be adapted to secure the axle of the pivot wheel a first distance from the top surface of the board in a first configuration and to secure the axle of the pivot wheel a second distance from the top surface of the board different than the first distance in a second configuration. In some embodiments, the apparatus further comprises a hand brake apparatus connected to the brake apparatus by a cable for controlling the brake apparatus. The hand brake apparatus may be adapted to engage the brake apparatus to increase friction on the pivot wheel if in a first mode and to disengage the brake apparatus to decrease friction on the pivot wheel if in a second mode.

In various embodiments of the present invention, the apparatus further comprises one or more low friction elements coupled to a bottom surface of the board between the pivot wheel and the first end of the board, the low friction elements having a lower friction coefficient than the board. Further, the apparatus may comprise one or more low friction elements coupled to the bottom surface of the board between the pivot wheel and the second end of the board, the low friction elements having a lower friction coefficient than the board. The low friction elements may comprise one or more first wheels coupled to the bottom surface of the board between the pivot wheel and the first end of the board, the first wheels having substantially smaller diameter than the pivot wheel. The board may comprise a hole above each of the first wheels and each of the first wheels may be coupled to the board such that a portion of each of the first wheels protrude through the corresponding hole in the board. The board may comprise a brake mechanism adapted to be applied by a foot onto at least one of the first wheels protruding above the board. Each of the first wheels may be coupled to the bottom surface of the board using a caster that enables the first wheels to swivel. In alternative embodiments, the low friction element may comprise a tube runner.

In one embodiment, the apparatus may further comprise one or more first wheels coupled to a bottom surface of the board between the pivot wheel and the first end of the board and one or more second wheels coupled to the bottom surface of the board between the pivot wheel and the second end of the board. In this case, the first and second wheels may have substantially smaller diameters than the pivot wheel. In one implementation, the pivot wheel may have a diameter between six and eighteen inches and the first and second wheels may have diameters between one and six inches. In one specific case, the pivot wheel may be substantially similar to a bicycle wheel and the first and second wheels may be substantially similar to in-line skate wheels. In some cases, the board may comprise a hole above each of the first and second wheels and each of the first and second wheels may be coupled to the board such that a portion of each of the first and second wheels protrudes through the corresponding hole in the board. Further, the apparatus may comprise a brake mechanism adapted to be applied by a foot onto at least one of the first and second wheels protruding above the board; a cover coupled to the board that covers at least part of the second portion of the pivot wheel above the board; and/or a first foot hold integrated onto the top surface of the board between the pivot wheel and the first end and a second foot hold integrated onto the top surface of the board between the pivot wheel and the second end, whereby a user can lock their feet to the board with one foot on either side of the pivot wheel. In some embodiments, the pivot wheel may be substantially similar to a bicycle wheel comprising a central hub, a circular rim coupled to the hub and a tire affixed to the outer edge of the rim. In some embodiments, the board comprises first and second widthwise edges and the board is curved in an upward concave form between the first and second widthwise edges.

According to a second broad aspect, the present invention is an apparatus comprising: an elongated board, a pivot wheel, a first wheel, and a brake mechanism. The board is adapted for a user to stand on, the board having a length with first and second ends, a first hole at a pivot location between the first and second ends and a second hole between the first hole and the first end. The pivot wheel is coupled to the board and protrudes through the first hole such that the pivot wheel is adapted to rotate in parallel with the length of the board, a first portion of the pivot wheel being below the board and a second portion of the pivot wheel being above the board. The first wheel is coupled to a bottom surface of the board between the first hole and the first end of the board, below the second hole such that a portion of the first wheel protrudes through the second hole. The first wheel has a substantially smaller diameter than the pivot wheel. The brake mechanism is adapted to be applied by a foot onto the portion of the first wheel that protrudes through the second hole above the board.

According to a third broad aspect, the present invention is an apparatus comprising: an elongated board, a pivot wheel and a wheel mounting apparatus. The board is adapted for a user to stand on, the board having a length with first and second ends and a hole at a pivot location between the first and second ends. The pivot wheel is coupled to the board and protrudes through the hole such that the pivot wheel is adapted to rotate in parallel with the length of the board, a first portion of the pivot wheel being below the board and a second portion of the pivot wheel being above the board. The pivot wheel comprises a central axle. The wheel mounting apparatus is coupled to the board adjacent to the hole at the pivot location and is adapted to secure the axle of the pivot wheel above a top surface of the board. The wheel mounting apparatus is adapted to secure the axle of the pivot wheel a first distance from the top surface of the board in a first configuration and to secure the axle of the pivot wheel a second distance from the top surface of the board different than the first distance in a second configuration.

According to a fourth broad aspect, the present invention is a wheel mounting apparatus adapted to be coupled to an elongated board having a length with first and second ends and a hole at a pivot location between the first and second ends. The wheel mounting apparatus comprises: an axle mounting element adapted to secure an axle of a wheel protruding through the hole of the board at the pivot location above a top surface of the board such that the pivot wheel is adapted to rotate in parallel with the length of the board. The axle mounting element is adapted to secure the axle of the wheel a first distance from the top surface of the board in a first configuration and to secure the axle of the pivot wheel a second distance from the top surface of the board different than the first distance in a second configuration.

According to a fifth broad aspect, the present invention is an apparatus comprising: an elongated board adapted for a user to stand on, a pivot wheel and one or more first wheels. The board has a length with first and second ends, a first hole at a pivot location between the first and second ends and one or more second holes between the first hole and the first end. The pivot wheel is coupled to the board and protrudes through the first hole such that the pivot wheel is adapted to rotate in parallel with the length of the board, a first portion of the pivot wheel being below the board and a second portion of the pivot wheel being above the board. Each of the first wheels are coupled to a bottom surface of the board between the pivot wheel and the first end of the board, each of the first wheels implemented below one of the second holes in the board such that a portion of each of the first wheels protrude through a corresponding one of the second holes in the board. The first wheels have substantially smaller diameters than the pivot wheel. In some embodiments, the board further has one or more third holes between the pivot wheel and the second end. In this case, the apparatus further comprises one or more second wheels coupled to the bottom surface of the board between the pivot wheel and the second end of the board, each of the second wheels implemented below one of the third holes in the board such that a portion of each of the second wheels protrude through a corresponding one of the third holes in the board. The second wheels also have substantially smaller diameters than the pivot wheel.

According to a sixth broad aspect, the present invention is an elongated board adapted to be coupled to a pivot wheel and one or more first wheels to form a board apparatus. The board is adapted for a user to stand on and has a length with first and second ends. The board comprises a first elongated hole at a pivot location between the first and second ends, the first hole being parallel lengthwise with the board and adapted for a pivot wheel to protrude through if the pivot wheel is coupled to a top surface of the board. The board further comprises at least one second hole between the first hole and the first end, the second hole adapted for a first wheel to protrude through if the first wheel is coupled to a bottom surface of the board. The diameter of the pivot wheel is substantially larger than a diameter of the first wheel.

According to a seventh broad aspect, the present invention is an elongated board adapted to be coupled to a pivot wheel to form a board apparatus. The board is adapted for a user to stand on and has a length with first and second ends. The board comprises a first elongated hole at a pivot location between the first and second ends, the first hole being parallel lengthwise with the board and adapted for a pivot wheel to protrude through if the pivot wheel is coupled to a top surface of the board. The board further comprises first and second widthwise edges and the board is curved in an upward concave form between the first and second widthwise edges.

According to an eighth broad aspect, the present invention is an apparatus comprising: an elongated board and a pivot wheel. The board is adapted for a user to stand on, the board having a length with first and second ends and a hole at a pivot location between the first and second ends. The pivot wheel is coupled to the board and protruding through the hole such that the pivot wheel is adapted to rotate in parallel with the length of the board, a first portion of the pivot wheel being below the board and a second portion of the pivot wheel being above the board. The board comprises first and second widthwise edges and the board is curved in an upward concave form between the first and second widthwise edges.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which:

FIG. 2B is a zoomed-in view of components of the wheel mounting mechanism of FIG. 2A according to an embodiment of the present invention;

FIGS. 2C and 2D are front views of two embodiments of wheel mounting mechanism and FIGS. 2E and 2F are a side view and a top view of the wheel mounting mechanism of FIGS. 2C and 2D;

Figure 1A:
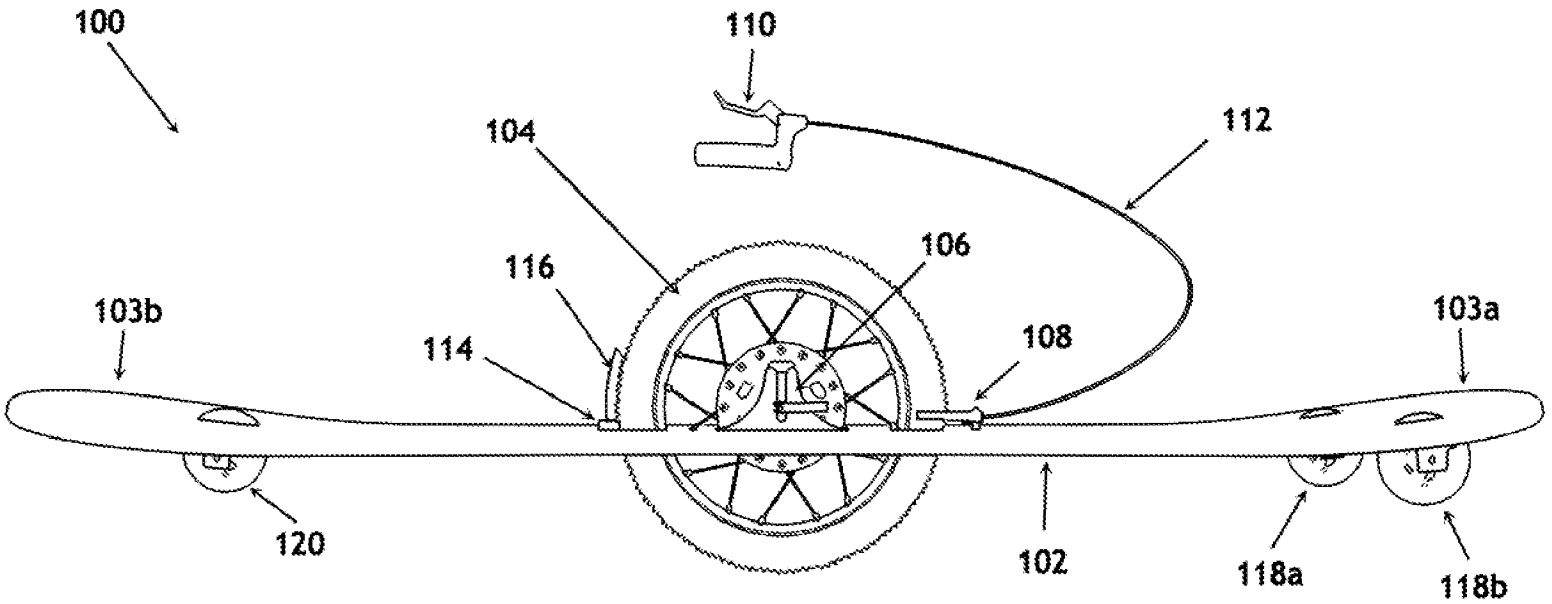
FIGS. 1A, 1B, 1C and 1D are a side view, a front view, a top view and a rear view respectively of a board apparatus according to one embodiment of the present invention.
Figure 1B:
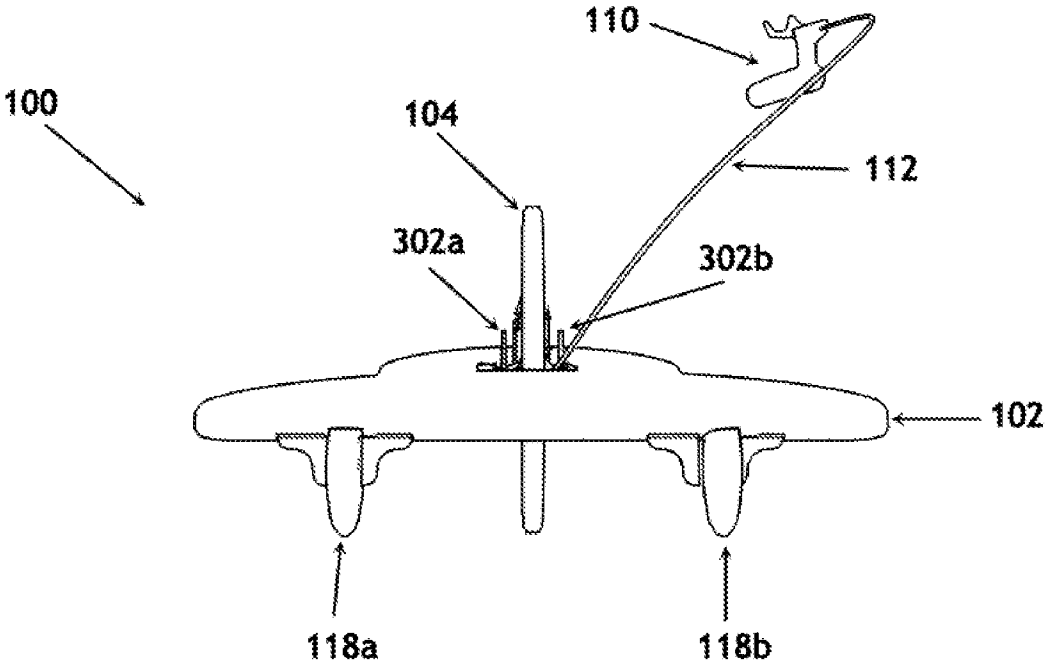
Figure 1C:
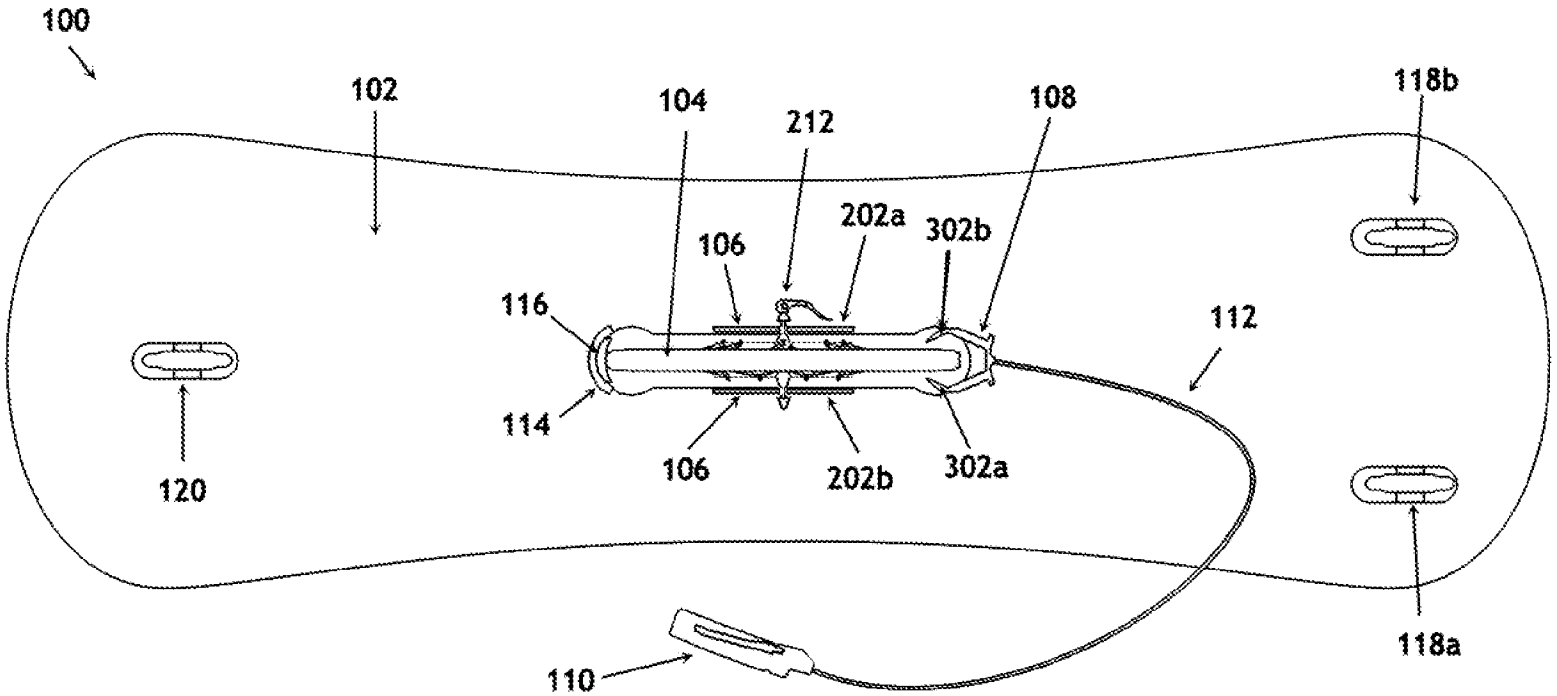
Figure 1D:
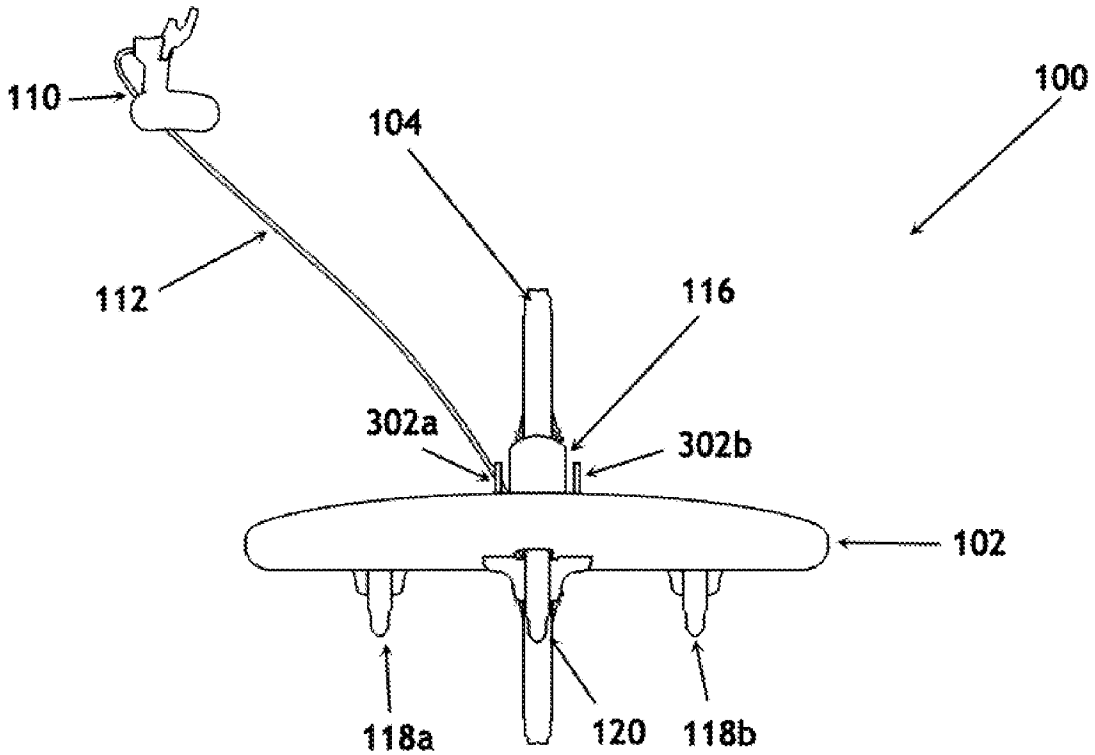

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to a board apparatus that a user can ride and use to traverse inclines, the board apparatus comprising an elongated board with a pivot wheel protruding through the board such that the pivot wheel is adapted to rotate in parallel with the length of the board. In some embodiments of the present invention, the pivot wheel is similar to a small bicycle wheel that is integrated substantially central lengthwise within the board and has its axle integrated above the board's top surface. A user of the board apparatus can stand on the board with one foot between the pivot wheel and the front end of the board and their other foot between the pivot wheel and the rear end of the board, balancing a substantial portion of their weight on the pivot wheel. By adjusting their weight on the pivot wheel, the user is able to control the board's direction of travel. The user can twist clockwise and counter clockwise to cause the board apparatus to rotate beneath them. As well, the user can shift their weight from one side to another to cause the direction of travel of the board apparatus to curve slightly in the direction of the lean. The board apparatus of the present invention replicates a snowboard motion both with the stance of the user facing perpendicular to the direction of motion and in the ability to turn from side to side by shifting the user's mass from one side of the board apparatus to the other.

In various implementations of the present invention, the board apparatus further comprises a brake apparatus integrated to the pivot wheel that allows a user to maintain control over the speed of the board apparatus as it gains momentum going down inclines. In some cases, the pivot wheel is a standard bicycle wheel and the brake apparatus is a standard bicycle brake with a hand grip that the user can squeeze to apply brake pressure to the pivot wheel.

The board apparatus can maintain momentum as it traverses a downward incline by storing the forward motion of the user as potential energy. As small obstructions occur, the stored energy in the mass of the user transfers back into the board apparatus which may allow the board apparatus to overcome the obstacle and continue down the incline. The board apparatus may also include momentum wheels, substantially smaller than the pivot wheel, or other low-friction elements on the bottom surface of the board at the front and/or back end of the board. The momentum wheels may protrude through the board and can allow the board apparatus to maintain momentum if the front or back ends of the board make contact with the ground.

When a user balances their weight on the pivot wheel and attempts to traverse a downward incline, the pivot wheel can provide rolling motion and provide stability Like a bicycle, once the board apparatus reaches sufficient speed, the pivot wheel may act like a fly wheel, stabilizing the board apparatus. In this way, the larger the pivot wheel used, the more stable the board apparatus may become at particular speeds but the wider the stance a user would need to take to stand with one foot on either side of the pivot wheel. In operation, the board apparatus can allow a user to safely traverse a downward incline, such as a grassy hill, while balancing on a board and enjoying an experience similar to riding a snowboard on a snow covered hill.

FIGS. 1A, 1B, 1C and 1D are a side view, a front view, a top view and a rear view respectively of a board apparatus 100 according to one embodiment of the present invention. As shown, the board apparatus 100 comprises an elongated board 102 with front and rear ends 103*a*, 103*b* respectively and a pivot wheel 104 integrated lengthwise through a hole 122 within the board 102 such that the pivot wheel 104 is adapted to rotate in parallel with the length of the board 102. As shown, the pivot wheel 104 is affixed to the board 102 via a wheel mount apparatus 106 which, in this embodiment, is affixed to the top side of the board 102 and is located substantially central between the front and rear ends 103*a*, 103*b* in the board 102. The pivot wheel 104 can rotate clockwise or counter clockwise in parallel with the length of the board 102 such that when the board 102 is balanced on the pivot wheel 104, the board apparatus 100 may move lengthwise with the front end 103*a* leading the way or, if reversed in direction, with the rear end 103*b* leading the way.

In the embodiment of FIGS. 1A-1D, the board apparatus 100 further comprises a wheel brake mechanism 108 coupled to the top side of the board 102 directly on the front side of the pivot wheel 104 and a foot guard 114 and fender 116 coupled to the top side of the board 102 directly on the rear side of the pivot wheel 104. The wheel brake mechanism 108 is implemented to apply friction to the pivot wheel 104 and may be controlled by a hand brake mechanism 110 via a brake cable 112. The board apparatus 100 of FIGS. 1A-1D further comprises first and second front momentum wheels 118*a*, 118*b* affixed to the bottom side of the board 102 and integrated through holes 124*a*, 124*b* in the board 102 at the front end 103*a* and a rear momentum wheel 120 affixed to the bottom side of the board 102 and integrated through a hole 126 in the board 102 at the rear end 103*b*.

In the embodiment of FIGS. 1A-1D, the board 102 is a flat board in the shape of a modified oval with the central portion being narrower than the ends 103*a*, 103*b*. FIG. 1E depicts the board 102 with all other elements removed. In other embodiments, the board 102 may be similar to various skateboards or snowboards in shape and take shapes including, but not limited to, an oval, circle or rectangle with one or more sharp or curved corners. In some embodiments, the board 102 may not be a flat board but instead may curve upwards at one or both ends. The curve on the front end could assist the board apparatus 100 to overcome oncoming obstacles while the curve on the back end of the board 102 could allow the user to change from a forward motion to a backward motion similar to a snowboarder's ability to reverse directions while maintaining assent down the incline. The board 102 may be composed of various different materials including, but not limited to, solid wood, plywood, plastics, metal, fiberglass and carbon fiber. The more solid the board apparatus 100, the easier it is for the user of the board apparatus 100 to keep the momentum wheels at the front and rear ends 103*a*, 103*b* of the board 102 from contacting the ground, thus keeping the weight of the user on the pivot wheel 104 and reducing friction. To maintain the strength in the board 102 and reduce the bend in the board 102, the board 102 may comprise structural supports such as armatures running from the front end 103*a* to the rear end 103*b*. The armatures may be made from many different materials including, but not limited to, metal, carbon fiber, polymer materials or other materials that are designed for integral strength. The material used and the flexibility of the board 102 may be decided based on individual user preferences or cost. In one embodiment, the board 102 could comprise plywood formed with slight lengthwise curvature similar to many skateboard designs. Gluing layers of plywood over a curved mould would benefit from the parabolic nature that resists direct forces that may be applied by the user of the board apparatus 100.

Figures 9A, 9B, 9C:
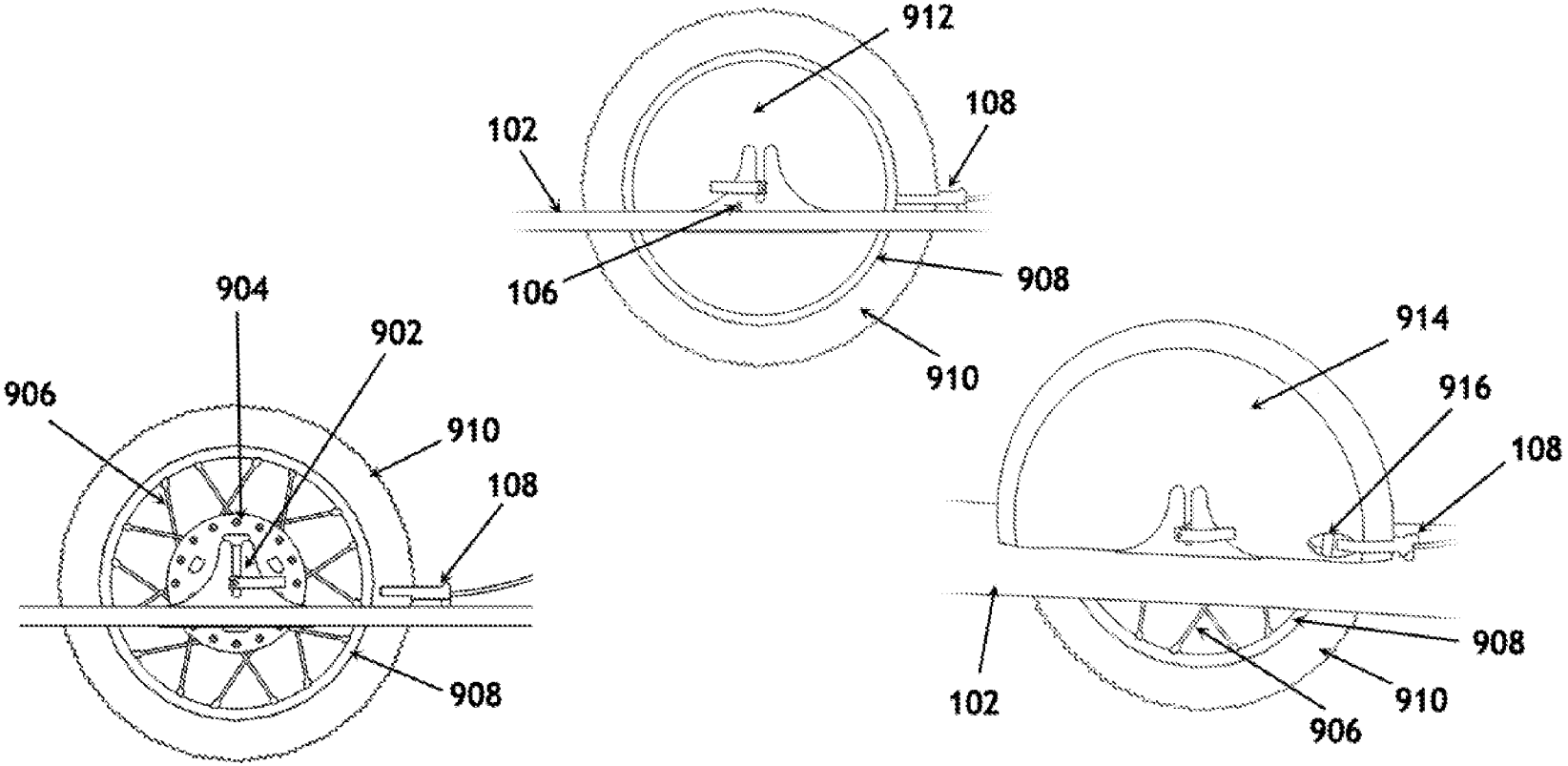
FIGS. 9A, 9B and 9C are zoomed-in views of first, second and third implementations of a pivot wheel respectively that may be implemented into board apparatus according to embodiments of the present invention.

The pivot wheel 104 in the embodiment of FIGS. 1A-1D is similar in structure to a small standard bicycle wheel as depicted in FIG. 9A. The pivot wheel in the embodiment of FIG. 9A comprises a central axle or spindle 902, a hub 904 for rotating around the axle 902, a rim 908 formed by a circular frame, a series of spokes 906 extending from the hub 904 to the rim 908 and a rubber tire 910 around the rim 908 inflated with an inner tube (not shown) on the outside of the rim 908. In other embodiments, the pivot wheel 104 may comprise alternative structures such as a solid wheel or one made with different materials, similar to the various materials that a bicycle wheel may be formed with. FIG. 9B illustrates an embodiment of the pivot wheel 104 in which the spokes 906 are removed and they are replaced with a solid disc element 912 that connects the hub 904 to the rim 908. In other embodiments, the pivot wheel 104 may be covered to protect a user from touching the rotating wheel. FIG. 9C illustrates an embodiment of the board apparatus 100 in which a cover 914 has been connected to the board 102 to cover the portion of the pivot wheel 104 that is protruding through the hole 122 and is above the top surface of the board 102. In this case, a user of the board apparatus 100 may be prevented from touching the pivot wheel 104 in operation by error. As shown, the cover 914 may have a hole 916 to allow for the wheel brake mechanism 108 to still engage with the pivot wheel 104. Yet further, instead of a fixed axle (or spindle) and hub architecture like a standard bicycle wheel, a system with a central axle that is fixed to the wheel and rotates with the wheel may be implemented.

The diameter of the pivot wheel 104 in FIGS. 1A-1D is approximately 12 inches, though the diameter may be larger or smaller and in many implementations would be between 6" and 18" in diameter. As will be described, the diameter of the pivot wheel 104 can affect the operation of the board apparatus 100 and may be selected based upon the size of the user, the experience of the user, the preference of the user, the weather conditions, the terrain conditions and/or other factors that may lead to a different operating parameter. In particular, the larger the diameter of the pivot wheel 104 is, the wider the stance required to be taken by the user to avoid the user from rubbing against the pivot wheel 104. Therefore, a larger pivot wheel 104 (ex. 14-16 inches) may be used for larger users. A smaller pivot wheel 104 could allow the user to have a tighter stance but, as will be described, may need higher speeds to achieve stability. Further, the inflation or deflation of the tire of the pivot wheel 104 may affect the performance and experience of the board apparatus 100.

The wheel mounting mechanism 106 of FIGS. 1A-1D is illustrated in detail with reference to FIGS. 2A and 2B. In this embodiment, the wheel mounting mechanism 106 comprises first and second base elements 204*a*, 204*b* comprising a flat plate affixed flush on the top side of the board 102 lengthwise beside either side of the hole 122; and first and second axle mounting elements 202*a*, 202*b* connected to the corresponding first and second base elements 204*a*, 204*b* and oriented vertically perpendicular to the board 102 on either side of the hole 122 for the pivot wheel 104 in the board 102. The base elements 204*a*, 204*b* may be mounted to the board 102 with bolts 214 from the top surface of the board 102, though the base elements 204*a*, 204*b* may be bolted from the bottom surface of the board 102 or be affixed in another method including, but not limited to, an adhesive, nails, screws and rivets.

An axle 902 which forms part of the pivot wheel 104 in the implementation of FIGS. 1A-1D can be supported in place by the first and second axle mounting elements 202*a*, 202*b*. As shown, the axle mounting elements 202*a*, 202*b* have corresponding slots 206*a*, 206*b* in which ends of the axle 902 may be slid in place such that the axle 902 can be held on either side of the hole 122 that the pivot wheel 104 protrudes and the hub 904, spokes 906, rim 908 and tire 910 of the pivot wheel 104 can rotate around the fixed axle 902 (or spindle). In the embodiment of FIGS. 2A and 2B, each of the axle mounting elements 202*a*, 202*b* have a plurality of holes 208 vertically separated along the sides of their slots 206*a*, 206*b*. In the sample implementations depicted, there are four holes 208 on one side of the slots 206*a*, 206*b* and three holes on the other side of the slots 206*a*, 206*b*. It should be understood that more or fewer holes 208 could be implemented and, in some embodiments, holes may only be on one side of the slots 206*a*, 206*b* or the holes may be removed if alternative axle mounting mechanisms are used.

The plurality of holes 208 are at different vertical distances above the top side of the board 102. The wheel mounting mechanism 106 of FIGS. 2A and 2B further comprises first and second locating washers 210*a*, 210*b* corresponding to the first and second axle mounting elements 202*a*, 202*b*, each of the locating washers 210*a*, 210*b* consisting of a round washer with a pin for insertion into one of the holes 208 in its corresponding axle mounting elements 202*a*, 202*b*. As shown, the locating washers 210*a*, 210*b* may each be connected to their corresponding axle mounting elements 202*a*, 202*b* through the pins of the locating washers 210*a*, 210*b* connecting into one of the holes 208. The locating washers 210*a*, 210*b* when connected to the corresponding axle mounting element 202*a*, 202*b* forms a hole that positions the height of the axle 902 relative to the board 102. The holes 208 that are selected for insertion of the locating washers 210*a*, 210*b* dictate the distance above the board 102 that the axle 902 will be located and therefore the portion of the pivot wheel 104 that will be above the board 102 and the portion of the pivot wheel 104 that will protrude below the board 102. A skewer, such as quick release skewer 212 depicted in FIG. 2A, is connected to one of the ends of the axle 902 to lock the axle 902 in place and to not allow the axle 902 to rotate, instead allowing the hub 904, spokes 906, rim 908 and tire 910 of the pivot wheel 104 to rotate around the fixed axle 902. When activated by pushing the handle in, the skewer 212 may lock the axle 902 in place. When deactivated by pulling the handle out, the skewer 212 may release the axle 902 and allow for a user to move the locating washers to different holes 208 in the axle mounting elements 202*a*, 202*b*, thus adjusting the height of the pivot wheel 104. In one embodiment, the skewer 212 may be similar to skewers used to hold wheels in place on many bicycles. In other embodiments, there may be two skewers, one on each side of the axle 902. In further embodiments, the skewer 212 could be replaced with other mechanical elements including, but not limited to, a simple nut or another fastener with a threaded hole. In some embodiments, bearings (not shown) or other low-friction elements may be implemented in the hub 904 of the pivot wheel 104 to allow for the hub 904 of the pivot wheel 104 to rotate around the axle 902 with low friction.

The mechanical architecture of the wheel mounting mechanism 106 of FIGS. 2A and 2B allows for the adjusting of the height of the axle 902 for the pivot wheel 104 above the board 102 and therefore can allow the user to determine the portion of the pivot wheel 104 that protrudes below the board 102. It should be understood that alternative wheel mounting mechanisms may be implemented in other embodiments. For instance, the wheel mounting mechanism 106 may not allow for adjustments to the height of the axle 902 for the pivot wheel 104 above the board 102 and may instead be a fixed wheel mounting. Further, it should be understood that other mechanical structures could be used to affix the pivot wheel 104 to the board 102 while allowing the pivot wheel 104 to protrude through the hole 122 in the board 102 and allowing the pivot wheel 104 to rotate freely. For example, in some embodiments, the wheel mounting mechanism 106 may be affixed to the bottom side of the board 102. In some embodiments, a rotating axle may replace the fixed axle or spindle 902. In this case, the wheel mounting mechanism 106 may comprise mechanical elements to hold the axle in a particular location or height above the board 102 and would allow the axle to freely rotate as an integral part of the rotating pivot wheel 104. One skilled in the art would understand that a spindle is one type of axle and therefore the term axle is meant to include a rotating axle architecture in which the axle rotates with the wheel as well as a spindle architecture in which the axle is fixed and a hub within the wheel rotates around the axle.

FIGS. 2C and 2D are front views of two sample implementations of axle mounting elements illustrating different options for the holes. In FIG. 2C, the axle mounting element is depicted with three holes 220 along the slot 222 that enable quick release mechanisms to be employed. In FIG. 2D, the axle mounting element is depicted with four holes 224 on either side of the slot 226 to enable safety washer mechanisms to be employed. FIGS. 2E and 2F are a side view and a top view of an axle mounting element of either FIG. 2C or FIG. 2D according to one implementation. In this implementation, the axle mounting element may be mounted to the board 102 such that a bottom portion 228 of the axle mounting element is below the board 102 and an upper portion 230 of the axle mounting element is above the board 102. Holes 232 in the bottom portion 228 of the axle mounting element may be mounted to the bottomside of the board 102 with bolts with the upper portion 230 of the element including the slot for the axle to be mounted protruding through a hole in the board 102 to the topside of the board 102. In this implementation, the axle mounting element is affixed to the bottomside of the board 102 and the axle of the pivot wheel 104 is still mounted above the board 102.

Figure 3C:
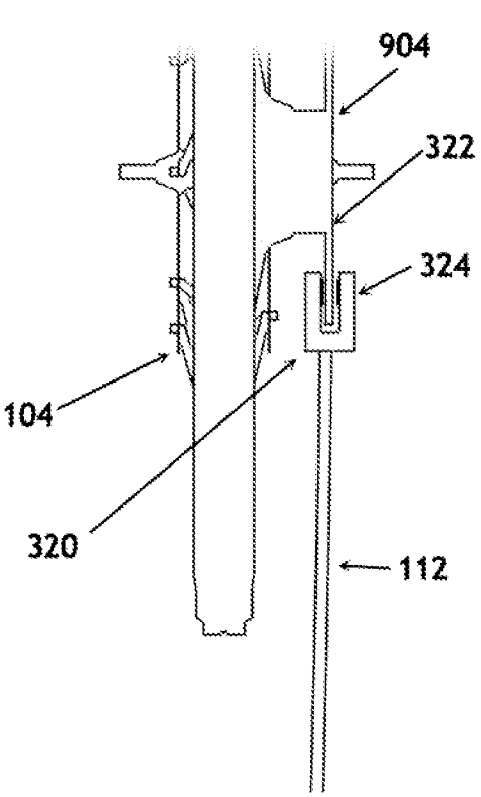
FIGS. 3A, 3B and 3C are zoomed-in views of first, second and third implementations of wheel brake mechanisms respectively that may be implemented into board apparatus according to embodiments of the present invention.
Figure 3B:
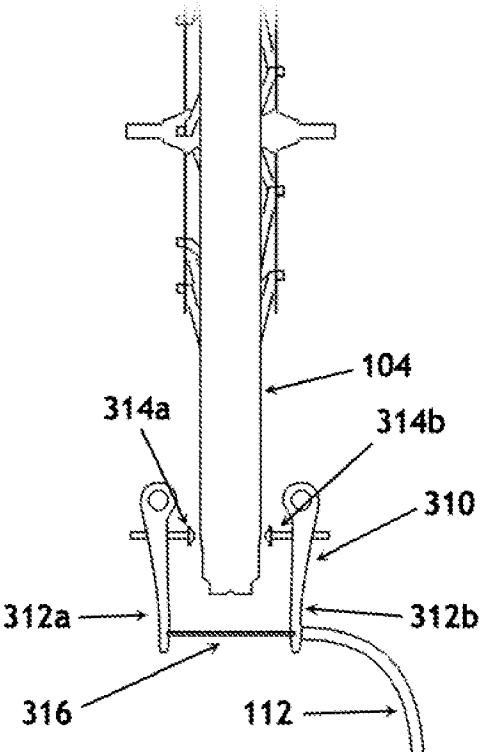
Figure 3A:
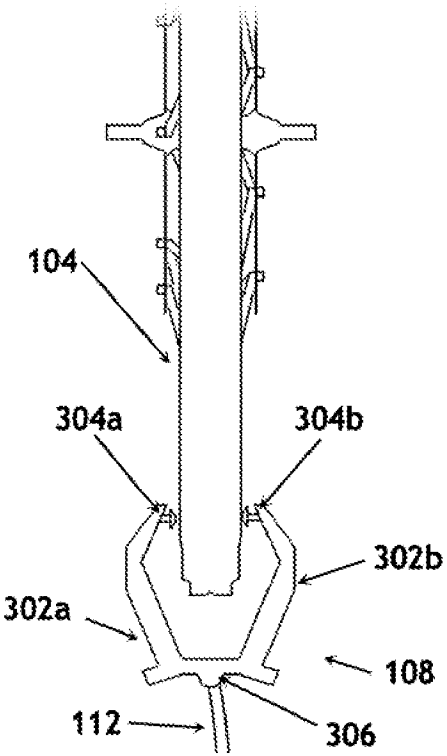

The wheel brake mechanism 108 in the embodiment of FIGS. 1A-1D comprises a standard bicycle rim brake system and is shown in detail with reference to FIG. 3A. The wheel brake mechanism 108 comprises two brake forks 302*a*, 302*b*, one on each side of the pivot wheel 104, brake pads 304*a*, 304*b* attached to the inner sides of the corresponding forks 302*a*, 302*b* and a spring mechanism 306 that can force the forks 302*a*, 302*b* apart, away from the pivot wheel 104. When the hand brake mechanism 110 is engaged by the user, the brake cable 112 constricts and forces the forks 302*a*, 302*b* to move towards each other and engage the brake pads 304*a*, 304*b* against the rim 908 of the pivot wheel 104. This engagement causes friction between the rim 908 of the pivot wheel 104 and the brake pads 304*a*, 304*b* to increase, thus potentially slowing or stopping the rotation of the pivot wheel 104 and decreasing the speed or stopping the movement of the board apparatus 100. When the hand brake mechanism 110 is not engaged by the user, the brake cable 112 expands and the spring forces the forks 302*a*, 302*b* apart and the brake pads 304*a*, 304*b* away from the rim 908 of the pivot wheel 104. This action reduces or removes the friction between the brake pads 304*a*, 304*b* and the rim 908 of the pivot wheel 104 and allows the pivot wheel 104 to move more freely, thus potentially increasing the rotation of the pivot wheel 104 and increasing the speed of movement of the board apparatus 100.

The wheel brake mechanism 108 depicted in FIGS. 1A-1D and FIG. 3A is a rim brake mechanism and is only one implementation possible for the present invention. Other brake mechanisms may be used including, but not limited to, spoon brakes, duck brakes, disc brakes and other versions of rim brake architectures. Various types of rim brakes include: rod-actuated brakes, caliper brakes, side-pull caliper brakes, dual-pivot side-pull caliper brakes, center-pull caliper brakes, cantilever brakes, linear-pull brakes or direct-pull brakes (also known as V-brakes), mini-V-brakes, roller cam brakes, delta brakes and hydraulic rim brakes. FIG. 3B depicts an implementation with linear-pull or direct-pull brakes 310 (also known as V-brakes) in which the forks 302*a*, 302*b* are replaced by first and second arms 312*a*, 312*b* that are pulled together when the hand brake 110 is engaged using a noodle 316. Each of the two arms 312*a*, 312*b* are connected to a corresponding brake pad element 314*a*, 314*b* that can engage with the rim 908 of the pivot wheel 104 when the hand brake mechanism 110 is engaged, creating friction between the brake pad elements 314*a*, 314*b* and the rim 908 and as a result reducing the speed of rotation or stopping rotation of the pivot wheel 104.

FIG. 3C depicts an implementation of a disc brake 320 within the board apparatus 100 in which the braking is performed on a disc 322 parallel to the pivot wheel 104. The disc 322 may be coupled to the hub 904 of the pivot wheel 104 and may rotate with and the hub 904. The hub 904 may be larger than in other implementations of the pivot wheel 104. In an alternative implementation, the center of the disc 322 may be coupled to the axle 902 and the axle 902 may rotate with the pivot wheel 104 and the disc 322 may rotate with the axle 902. Calipers 324 engage with the disc 322 when the hand brake 110 is engaged, creating friction between the calipers 324 and the disc 322 and as a result reducing the speed of rotation or stopping rotation of the disc 322 which is connected to the pivot wheel 104 and therefore reduces the speed of rotation or stops the rotation of the pivot wheel 104. The disc brake 320 may be mechanically actuated, as with a cable, or hydraulically actuated, or a combination of the two.

Figure 1E:
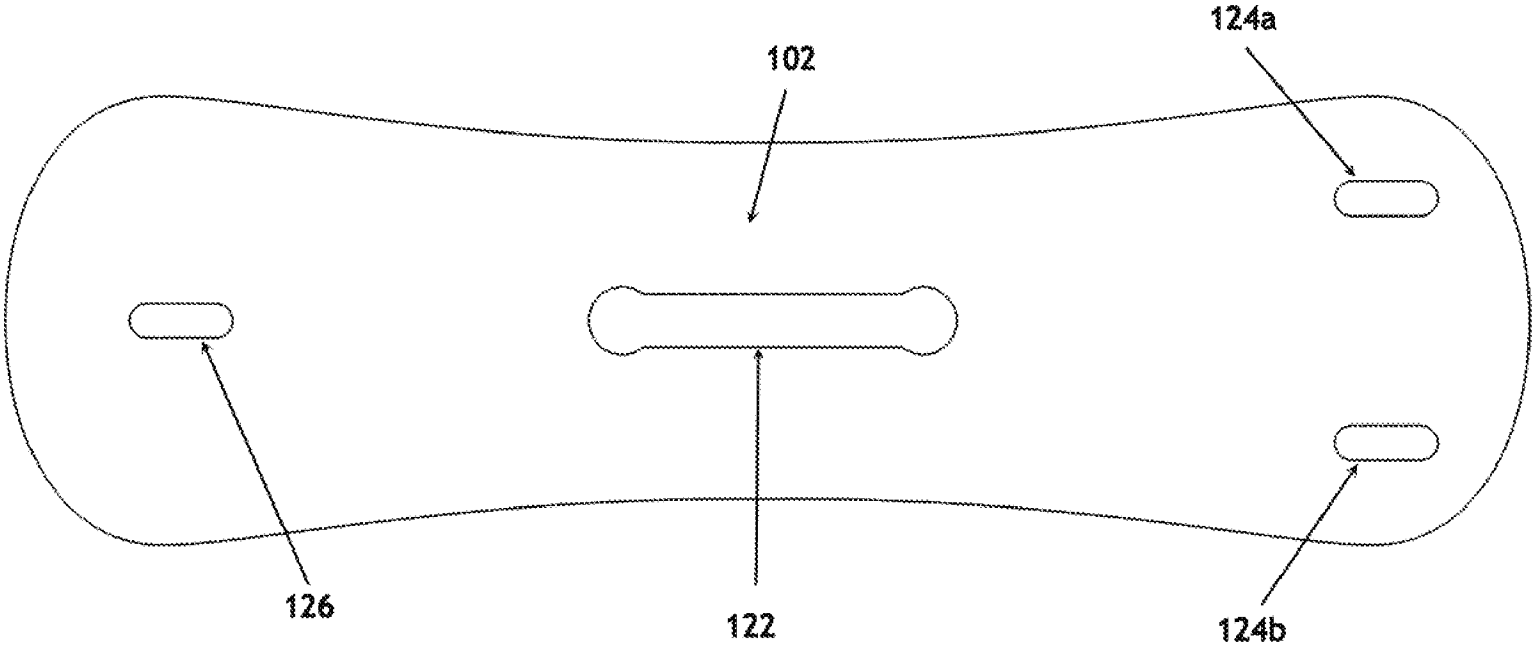
FIG. 1E is a top view of a board that may be implemented into a board apparatus according to one embodiment of the present invention.
Figure 1F:
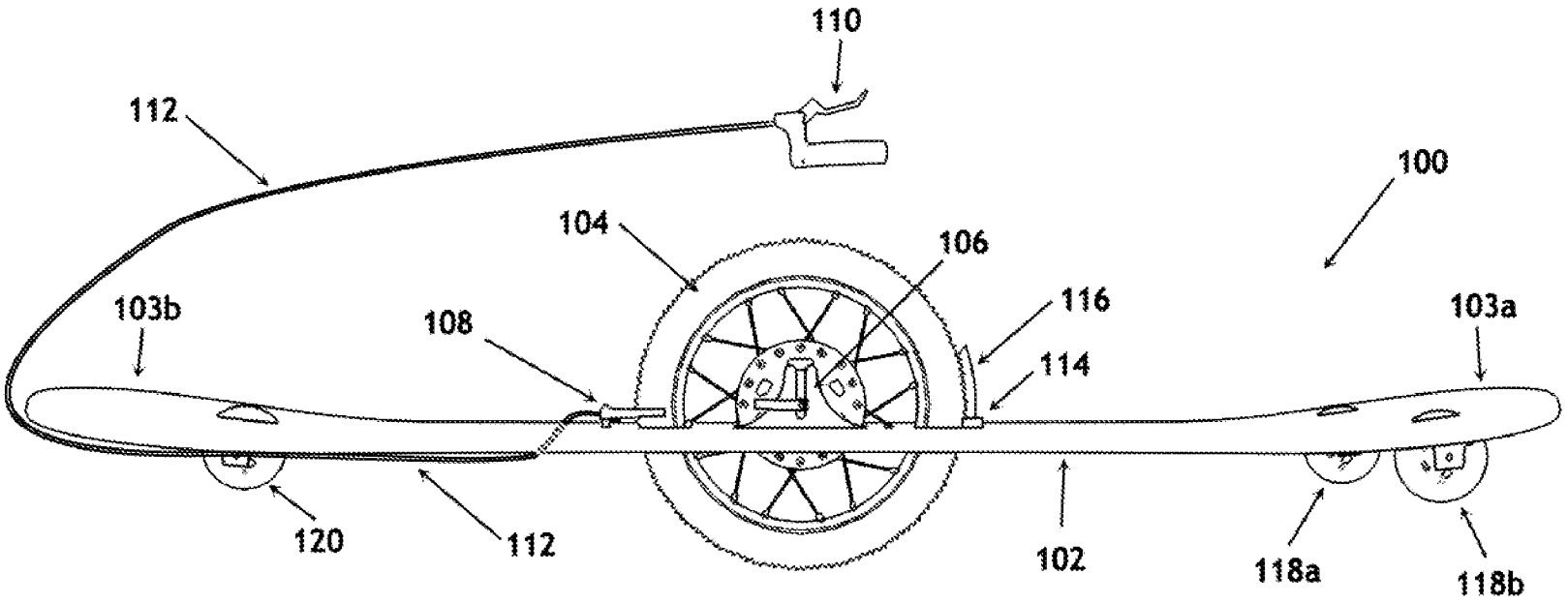
FIG. 1F is a side view of a board apparatus according to an embodiment of the present invention with an alternative brake cable implementation.
Figure 2A:
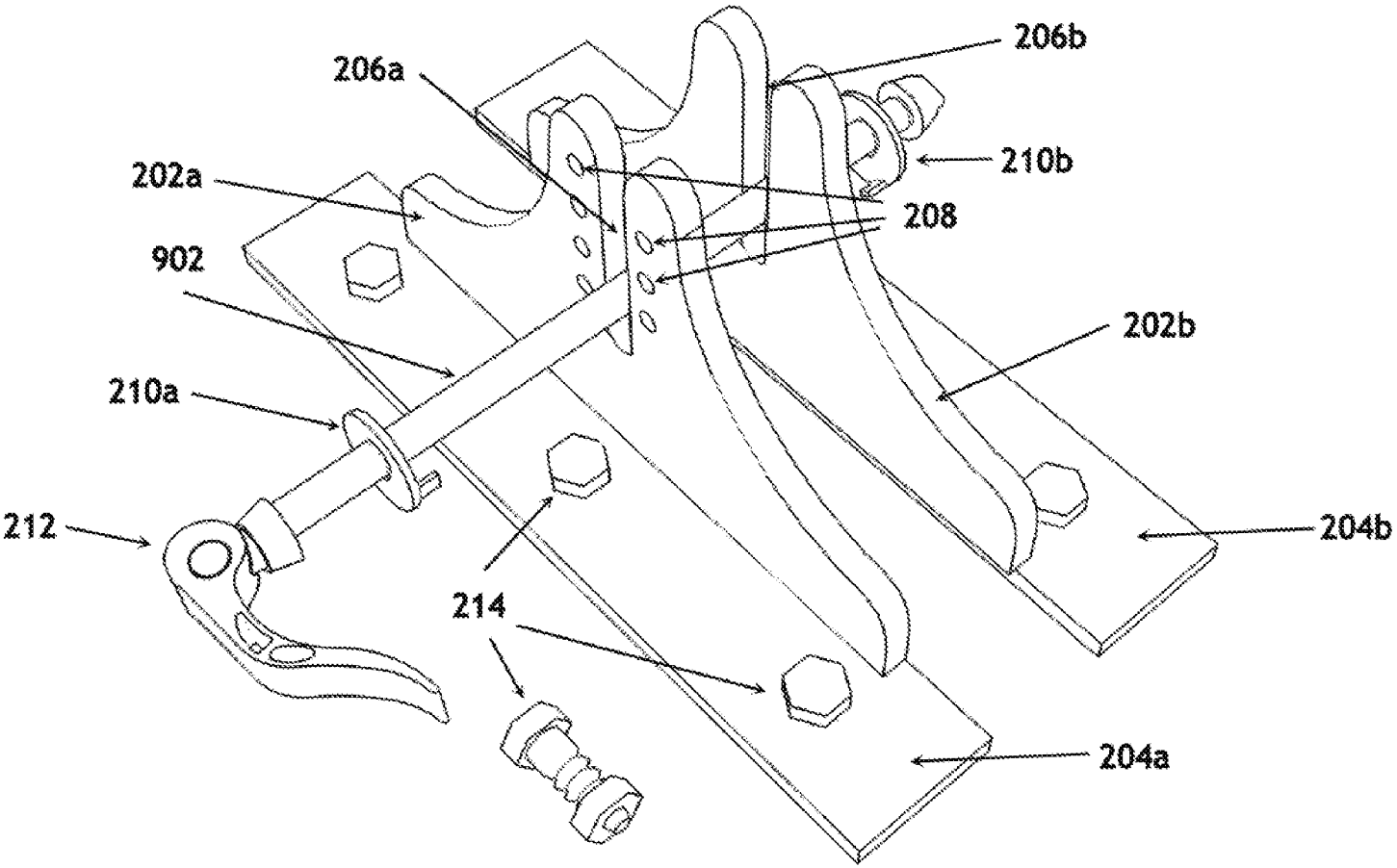
FIG. 2A is a breakout view of a wheel mounting mechanism according to one embodiment of the present invention.

In FIG. 1A, the wheel brake mechanism 108 is depicted as being implemented on the topside of the board 102 adjacent to the pivot wheel 104 between the pivot wheel 104 and the front end 103*a*. The brake cable 112 is depicted as being connected relatively directly to the hand brake mechanism 110. In alternative embodiments, the wheel brake mechanism 108 may be implemented in other locations adjacent to the pivot wheel 104, such as on the bottomside of the board 102 and/or between the pivot wheel 104 and the rear end 103*b* of the board 102. Further, in some embodiments, the brake cable 112 may be routed in various ways within or around the board 102 to mitigate inconvenience of the brake cable 112 for the user. FIG. 1F is a side view of a board apparatus with an alternative brake cable implementation. In this case, the wheel brake mechanism 108 is implemented on the topside of the board 102 adjacent to the pivot wheel 104 between the pivot wheel 104 and the rear end 103*b* of the board 102. The brake cable 112 is routed through a small hole in the board 102 to the bottomside of the board 102 and then routed along the bottom of the board 102 to the rear end 103*b*. In this configuration, the user can stand on the board 102 and the brake cable 112 does not normally interfere with their foot positions.

By having the brake cable 112 routed to the rear end 103*b* of the board 102, the hand brake mechanism 110 can be held conveniently in the user's hand on the same side of the body as the foot standing on the rear portion of the board 102. For example, if a user puts their left foot on the board 102 between the pivot wheel 104 and the front end 103*a* and puts their right foot on the board 102 between the pivot wheel 104 and the rear end 103*b*, the user may find it convenient to have the brake cable 112 routed to the rear end 103*b* of the board 102 and hold the hand brake mechanism 110 in their right hand. Similarly, if the user's left foot is positioned between the pivot wheel 104 and the rear end 103*b*, the user may find it convenient to hold the hand brake mechanism 110 in their left hand.

Figure 1G:
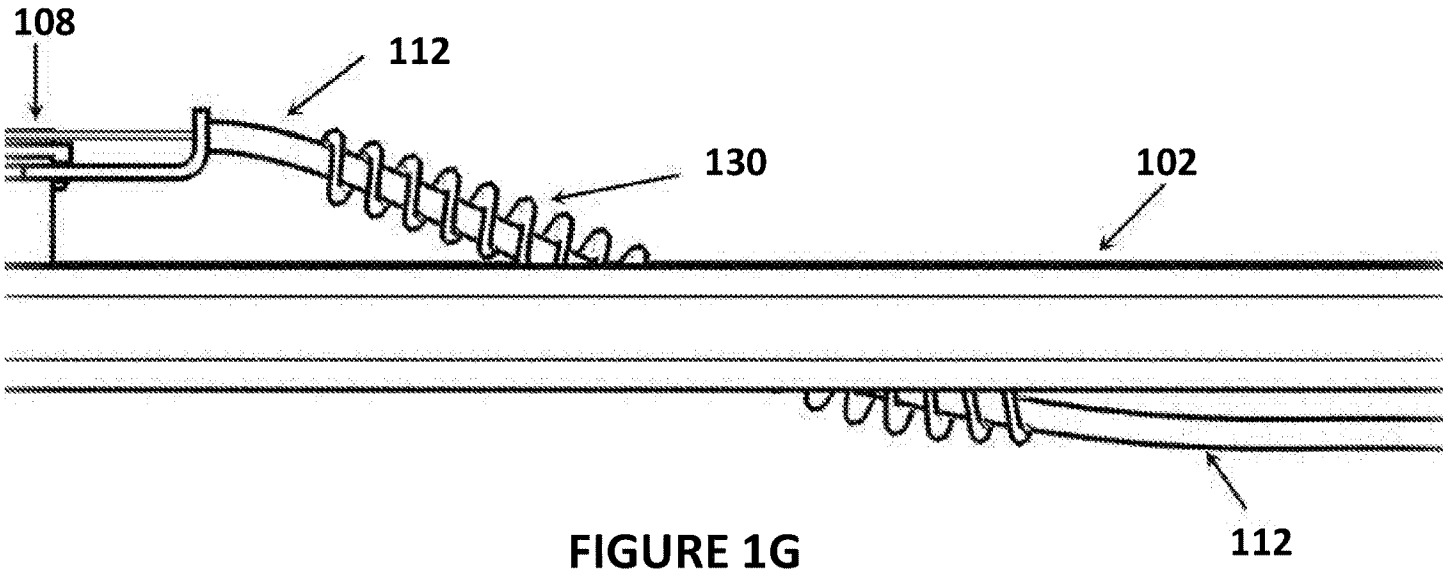
FIGS. 1G and 1H are zoomed-in views of aspects of the alternative brake cable implementation of FIG. 1F.
Figure 1H:
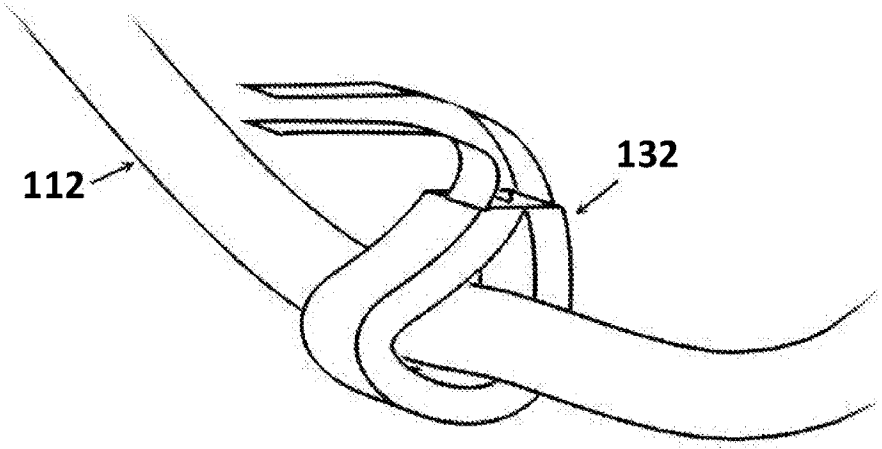

FIG. 1G is a zoomed-in view of the brake cable 112 as it is routed through a hole in the board 102 according to one implementation. In this embodiment, the brake cable 112 is surrounded by a tension spring 130 as it traverses the hole in the board 102. The tension spring 130 mitigates torque and pressure on the brake cable 112 and reduces potential damage to the brake cable 112. FIG. 1H is a zoomed-in view of the brake cable as it is routed under the board 102. In this embodiment, the brake cable 112 is coupled to the bottomside of the board (not shown in FIG. 1H) with a cable restraining clip 132. The cable restraining clip 132 holds the brake cable 112 close to the board 102 and mitigates the potential of the brake cable 112 from becoming entangled with the pivot wheel 104 or the rear momentum wheel 120 or becoming ensnared with an obstacle in the terrain that the board 102 traverses. In some embodiments, there may be a plurality of cable restraining clips 132 holding the brake cable 112 close to the board 102 and routing the brake cable 112 to the rear end 103*b* of the board 102.

Figure 4:
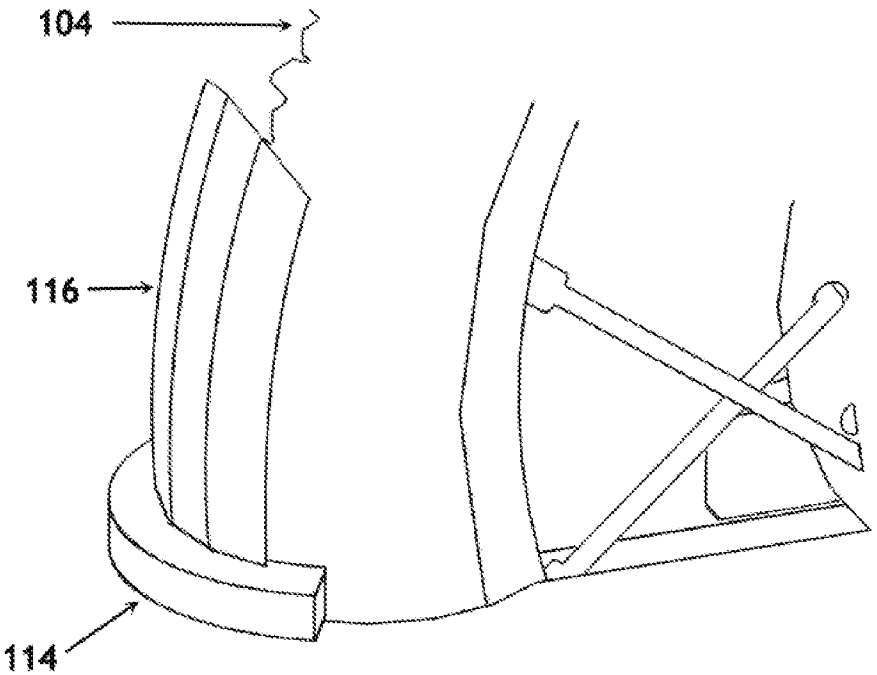
FIG. 4 is a zoomed-in view of the foot guard and the fender implemented within the board apparatus of FIGS. 1A-1D.

FIG. 4 is a zoomed-in view of the foot guard 114 and the fender 116 implemented within the board apparatus 100 of FIGS. 1A-1D. In this embodiment, the foot guard 114 is connected to the top surface of the board 102 and provides a raised edge that is shaped to curve around the pivot wheel 104. The foot guard 114 may prevent a user from accidently sliding their foot forward and bringing it into contact with the pivot wheel 104. In the embodiment of FIGS. 1A-1D, the foot guard 114 is only implemented around the pivot wheel 104 closer to the rear end 103*b* of the board 102. In other embodiments, the foot guard 114 may be on both sides of the pivot wheel 104 or may surround the entire hole 122 of the pivot wheel 104. The foot guard 114 may be composed of many materials including, but not limited to, plastic, rubber, wood or fiberglass.

The fender 116 is a cover that stretches up from the board 102 and covers a portion of the pivot wheel 104. In the case of FIGS. 1A-1D and FIG. 4, the fender 116 covers a portion of the pivot wheel 104 closest to the rear end 103*b* of the board 102 and may mitigate mud, water and/or debris that may be sprayed by the rotations of the pivot wheel 104 from hitting a user. The fender 116 may be integrated with the foot guard 114 or may be a separate element. The fender 116 may be composed of many materials including, but not limited to, plastic or rubber. In some embodiments, a fender may be implemented on both the front and rear side of the pivot wheel 104.

As shown in the embodiment of FIGS. 1A-1D, the front momentum wheels 118*a*, 118*b* are two adjacent wheels affixed to the bottom surface of the board 102 at the front end 103*a* of the board 102 that can rotate in parallel with the length of the board 102. In this implementation, the momentum wheels 118*a*, 118*b* protrude through holes 224*a*, 224*b* in the board 102 such that a portion of the front momentum wheels 118*a*, 118*b* extend above the board 102. The front momentum wheels 118*a*, 118*b* are designed to allow the board apparatus 100 to maintain momentum if the front end 103*a* of the board 102 touches the ground as the board apparatus 100 is in motion by minimizing the friction between the board apparatus 100 and the ground. Similarly, as shown in FIGS. 1A-1D, the rear momentum wheel 120 is affixed to the bottom surface of the board 102 centered at the rear end 103*b* of the board 102 and can rotate in parallel with the length of the board 102. In FIGS. 1A-1D, the rear momentum wheel 120 protrudes through a hole 226 in the board 102 such that a portion of the rear momentum wheel 120 extends above the board 102. The rear momentum wheel 120 is designed to allow the board apparatus 100 to maintain momentum if the rear end 103*b* of the board 102 touches the ground as the board apparatus 100 is in motion by minimizing the friction between the board apparatus 100 and the ground.

When riding the board apparatus 100, a user will attempt to maintain their weight over the pivot wheel 104 and minimize contact between the front and rear ends 103*a*, 103*b* and the ground being traversed. Maintaining momentum when contact is made between the ground and one of the front end 103*a* or rear end 103*b* is important. An event that causes significant friction between the board apparatus 100 and the ground can cause dramatic changes in speed and/or direction, thus potentially causing the user to lose control and/or to lose their balance and crash. In the implementation of FIGS. 1A-1D, the front and rear momentum wheels 118*a*, 118*b*, 120 are relatively small compared to the pivot wheel 104 and may be between 1 and 6 inches in diameter or approximately the size of a standard in-line skate wheel while the pivot wheel 104 may comprise the size of a small bicycle wheel or between 6 and 18 inches. The larger the momentum wheels 118*a*, 118*b*, 120 used, the more easily the board apparatus 100 can overcome uneven terrain and obstacles. At the same time, the size of the momentum wheels 118*a*, 118*b*, 120 should be limited since the purpose of these wheels is not to consistently have contact with the ground but to provide low friction contact points if the front end 103*a* or the rear end 103*b* makes contact with the ground. In some embodiments, the momentum wheels 118*a*, 118*b*, 120 may not be limited to rotating in parallel with the length of the board 102 and, instead, may be implemented to allow other angles of rotation. In some implementations, casters may be coupled to the board 102 to allow for a wide range of rotation angles of the front momentum wheels 118*a*, 118*b* and/or the rear momentum wheel 120.

The momentum wheels 118*a*, 118*b*, 120 protruding through the holes 124*a*, 124*b*, 126 of the board 102 has a number of advantages. Firstly, with a portion of the momentum wheels 118*a*, 118*b*, 120 being above the board 102, the board apparatus 100 can ride lower to the ground. Being lower to the ground can assist users, especially new users with limited experience. The more the distance between the board 102 and the ground, the more energy is required to keep the board apparatus 100 stable at lower speeds.

Secondly, if designed properly, having the momentum wheels 118*a*, 118*b*, 120 protruding through the holes 124*a*, 124*b*, 126 of the board 102 can reduce the potential of debris and other obstructions from interfering with the momentum wheels 118*a*, 118*b*, 120 as debris can flow away from the wheels 118*a*, 118*b*, 120 through the holes 124*a*, 124*b*, 126 in the board 102. Any obstructions interfering with the free rotation of the momentum wheels 118*a*, 118*b*, 120 can significantly affect the ride of the board apparatus 100 as it can prevent the momentum wheels 118*a*, 118*b*, 120 from being low friction elements and instead reduce the momentum of the board apparatus when the front end 103*a* or the rear end 103*b* make contact with the ground, thus potentially causing a dramatic change in speed and/or direction of the board apparatus 100.

It should be understood that the depiction of the front and rear momentum wheels 118*a*, 118*b*, 120 in FIGS. 1A-1D are only one embodiment of the present invention. In some embodiments, the size of the momentum wheels may be larger, which would allow the board apparatus 100 an improved ability to overcome uneven terrain and overcome obstacles. At the same time, to accommodate the larger momentum wheels, the pivot wheel 104 should be larger as well or be lowered so that the board apparatus 100 is raised up relative to the ground. The raising up of the board apparatus 100 is to ensure that the user's weight can be maintained primarily on the pivot wheel 104 and not consistently on the momentum wheels 118*a*, 118*b*, 120 at the front or rear ends of the board 102. In other embodiments, the momentum wheels 118*a*, 118*b*, 120 may be smaller than 1", though the smaller the wheels, the less effective they will be to overcome uneven terrain and overcome obstacles. In other embodiments, only a single momentum wheel may be implemented in the front end 103*a* of the board 102 or more than two momentum wheels may be implemented in the front end 103*a*. Further, more than one momentum wheel may be implemented in the rear end 103*b* of the board 102. In other embodiments, momentum wheels may only be implemented in one of the front end 103*a* or the rear end 103*b* instead of both ends of the board 102.

Figure 6A:
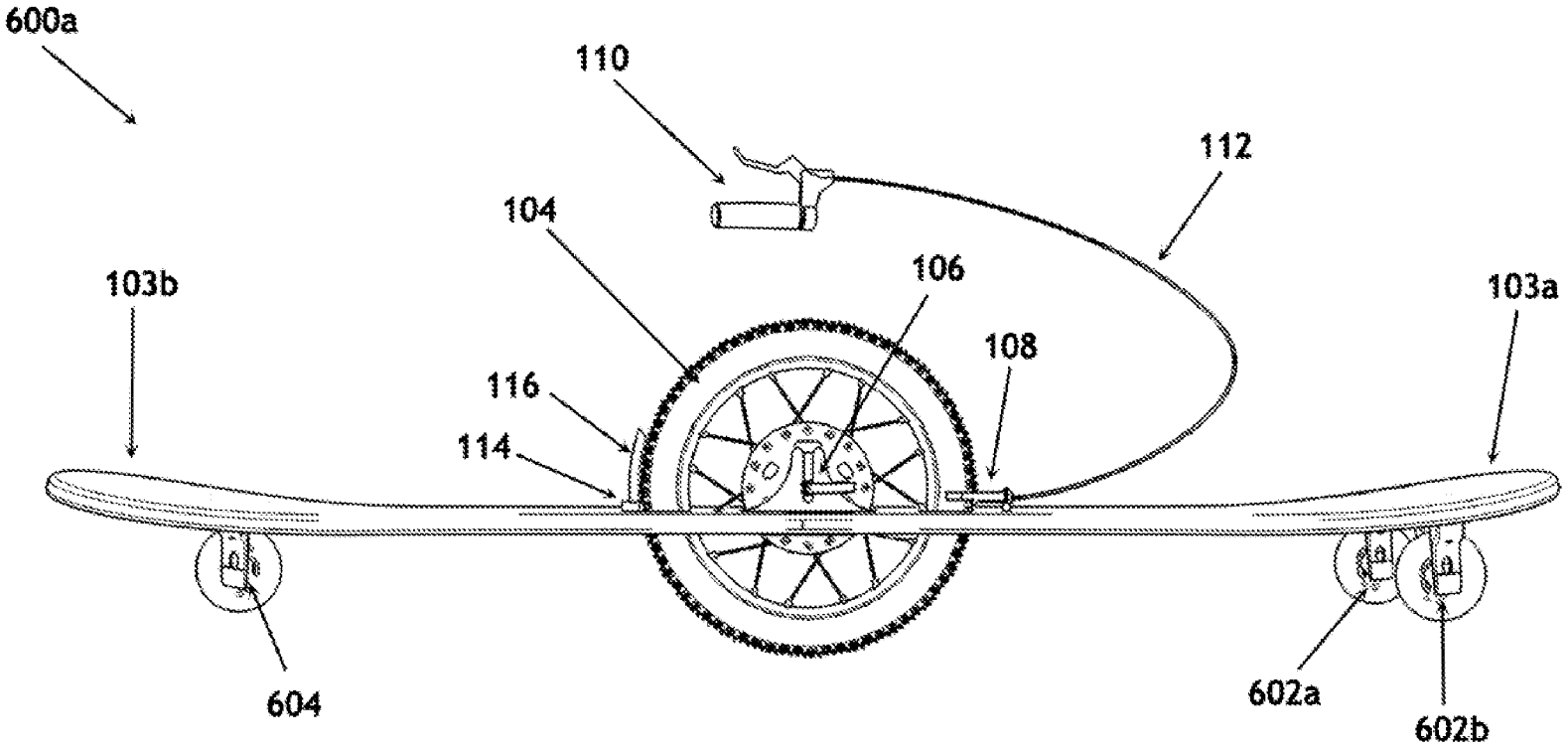
FIG. 6A is a side view of a board apparatus incorporating momentum wheels that do not protrude through the board according to an alternative embodiment of the present invention.

In some embodiments, the momentum wheels may not protrude through holes 124*a*, 124*b*, 126 of the board 102 and instead may be installed sufficiently below the bottom surface of the board 102 that the wheels can rotate freely without the need for holes in the board 102. FIG. 6A is a side view of a board apparatus 600*a* incorporating momentum wheels 602*a*, 602*b*, 604 that do not protrude through the board according to an alternative embodiment of the present invention. The board apparatus 600*a* is similar to board apparatus 100 but with no holes for the momentum wheels within the board 102. As shown, the board apparatus 600*a* comprises momentum wheels 602*a*, 602*b* implemented below the board 102 at the front end 103*a* and momentum wheel 604 implemented below the board 102 at the rear end 103*a*. Although depicted in FIG. 6A with two momentum wheels 602*a*, 602*b* at the front end 103*a* of the board 102 and one momentum wheel 604 at the rear end 103*b* of the board 102, it should be understood that more or less momentum wheels may be implemented in various alternative embodiments.

Figure 7A:
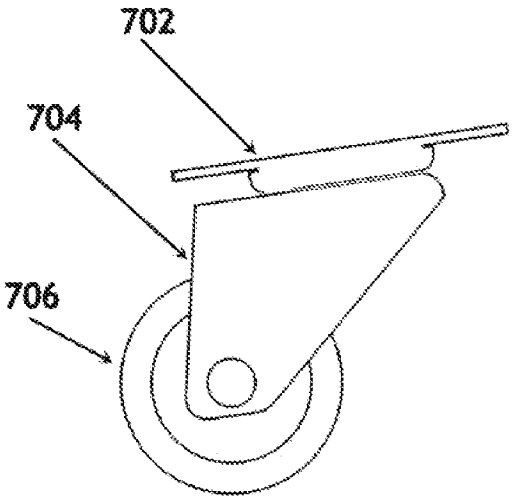
FIGS. 7A, 7B and 7C are zoomed-in views of first, second and third implementations of front and rear low friction elements respectively that may be implemented into board apparatus according to embodiments of the present invention.

FIG. 7A depicts a sample momentum wheel for implementation as one of the momentum wheels 602*a*, 602*b*, 604. In this case, each momentum wheel comprises a board mounting plate 702 adapted to be coupled to the bottom surface of the board 102; a wheel 706 comprising an axle; and a wheel mounting element 704 that is connected to the board mounting plate 702 and is adapted to hold the axle of the wheel 706 and enable the wheel 706 to rotate freely. In some embodiments, the board mounting plate 702 may comprise a caster that enables the wheel mounting element 704 and wheel 706 coupled to the wheel mounting element 704 to swivel and point the wheel 706 in various directions. This may allow the momentum wheels 602*a*, 602*b*, 604 to better reduce friction in cases that the front or rear ends 103*a*, 103*b* of the board 102 contact the ground at an angle or while the user is leaning to one side. In some implementations, the wheel 706 may be a variety of shapes including cylindrical or spherical, similar to some office chair wheels. In FIG. 7A, the axle may be fixed to the wheel mounting element 704 and act as a spindle in which the wheel 706 rotates around the axle or may be fixed to the wheel 706 and spin within a holding element of the wheel mounting element 704.

Figure 7B:
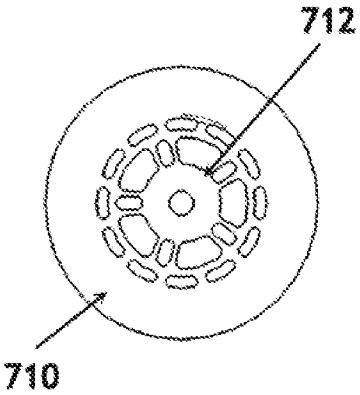

FIG. 7B illustrates a particular implementation of a momentum wheel in one embodiment in which the momentum wheel is similar to a standard in-line skate wheel 710 that includes a plurality of bearings to allow for the wheel to rotate with minimal friction around an axle or spindle. This implementation for a momentum wheel may be implemented in the embodiments of the board apparatus 100 of FIGS. 1A-1D and/or within the embodiment of the board apparatus 600*a* of FIG. 6A. In some embodiments of the present invention, the momentum wheels may be limited to a relatively small diameter compared to the pivot wheel 104. In some particular implementations, the diameter of the momentum wheels may be between 1 and 6 inches. By comparison, in some embodiments of the present invention, the pivot wheel 104 may have a diameter between 6 and 18 inches. The exact diameters of the momentum wheels and the pivot wheel used in various embodiments should not limit the scope of the present invention.

More generally, the momentum wheels of board apparatus 100 and board apparatus 600*a* can be understood to be low friction elements that allow for a minimal friction when the front end 103*a* or the rear end 103*b* of the board 102 comes in contact with the ground. In some embodiments, other low friction elements could be used instead of discrete wheels. Examples of low friction elements include, but are not limited to, other devices that roll such as wide wheels or rolling-pin like elements and devices that allow for the board apparatus to slide such as tube runners or other elements with relatively low friction coefficients. Using low friction elements that roll generally will allow more momentum to be maintained than using low friction elements that allow for the board apparatus to slide. This lower ability to maintain momentum may make it more difficult for a user to achieve and maintain speed with the board apparatus and therefore to maintain stability of the board apparatus as they traverse a downward incline. The tube runners and other elements that allow the board apparatus to slide may be lower cost alternatives and may require less maintenance than wheels or other rolling low friction elements.

Figure 6B:
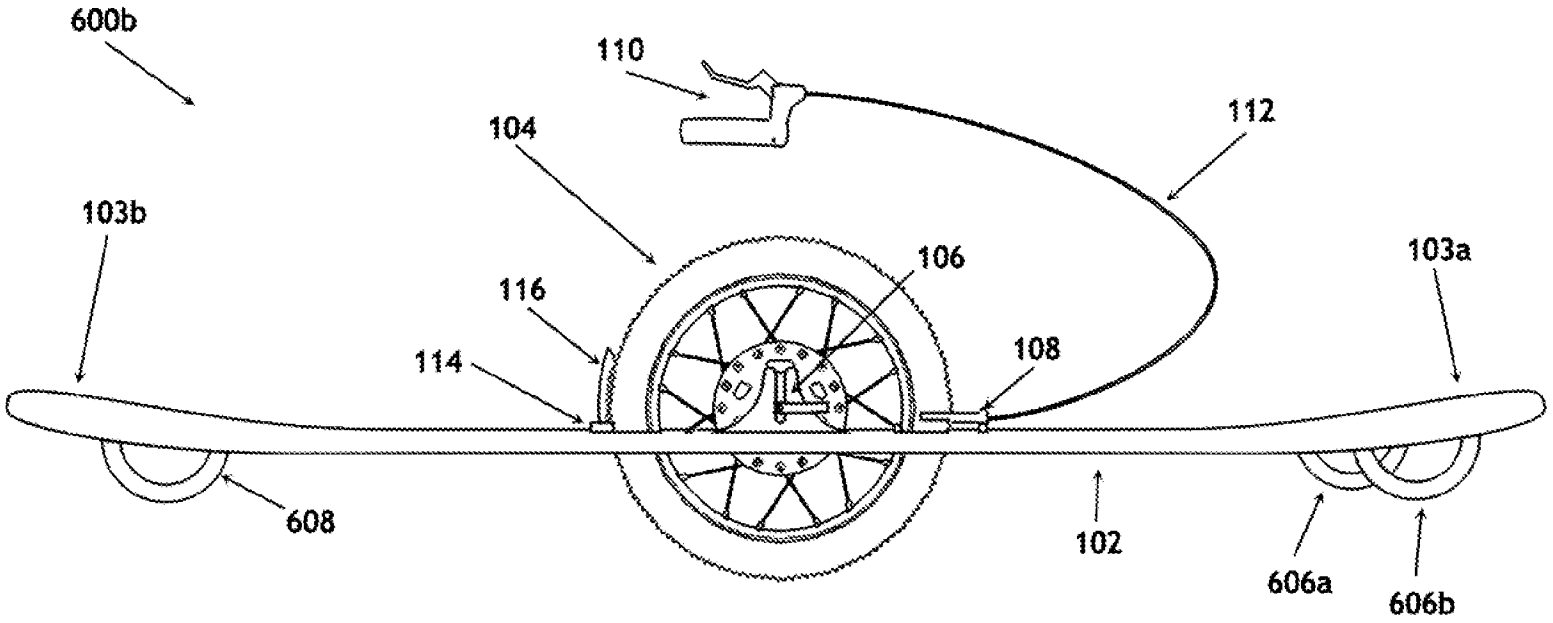
FIG. 6B is a side view of a board apparatus incorporating tube runners rather than momentum wheels according to an alternative embodiment of the present invention.
Figure 7C:
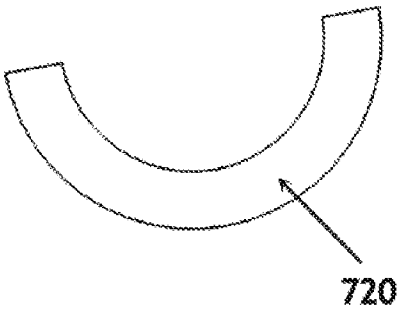

FIG. 6B is a side view of a board apparatus 600*b* incorporating tube runners 606*a*, 606*b*, 608 rather than momentum wheels. In this implementation, tube runners 720 as shown in FIG. 7C are used. These devices are half circle arches made from a low friction material. Sample low friction materials may include, but are not limited to, a plastic blend of polyurethane and/or Teflon. In some embodiments, the tube runners may be similar in material to the blade of a street hockey stick and/or coated in Teflon like a cooking pot. As shown in FIG. 6B, the board apparatus 600*b* comprises tube runners 606*a*, 606*b* implemented below the board 102 at the front end 103*a* and tube runner 608 implemented below the board 102 at the rear end 103*a*. Although depicted with two tube runners 606*a*, 606*b* at the front end 103*a* of the board 102 and one tube runner 608 at the rear end 103*b* of the board 102, it should be understood that more or less tube runners may be implemented in various alternative embodiments. Further, alternative shapes and materials for tube runners or other low friction elements that allow for sliding of the board apparatus may also be used in some implementations.

The embodiment of the present invention illustrated in FIGS. 1A-1D depict a wheel brake mechanism 108 implemented adjacent to the pivot wheel 104 between the pivot wheel 104 and the front end 103*a* of the board 102. The wheel brake mechanism 108 may be implemented in alternative locations in some implementations and may be replaced or augmented with other brake mechanisms on the board apparatus 100. Specifically, the wheel brake mechanism 108 may be implement adjacent to the pivot wheel 104 between the pivot wheel 104 and the rear end 103*b* of the board 102. Further, the wheel brake mechanism 108 could be implemented on the bottom surface of the board 102, though debris and other obstacles could interfere with its operation. To address the debris issue, a cover could be placed over the wheel brake mechanism 108 whether it is on the top surface or on the bottom surface of the board 102. In some embodiments, the wheel brake mechanism could be integrated such that it is internal to the board 102 adjacent to the pivot wheel 104 and may not be visible to a user of the board apparatus 100. As described previously, the wheel brake mechanism 108 may also take the form of many different mechanical mechanisms.

Further, the brake cable 112 in some embodiments may be routed through the board 102 such that it is coupled to the wheel brake mechanism 108 above the board 102 and then is routed to the back end 103*b* of the board 102 under the board 102. In this configuration, the wheel brake mechanism 108 would typically be implemented adjacent to the pivot wheel 104 between the pivot wheel 104 and the rear end 103*b* of the board 102 in order to reduce the potential of having the brake cable 112 interfering with the pivot wheel 104. An advantage of routing the brake cable 112 under the board 102 is to avoid the brake cable from interfering with a user's foot or causing a user to trip over the brake cable 112.

Figure 5:
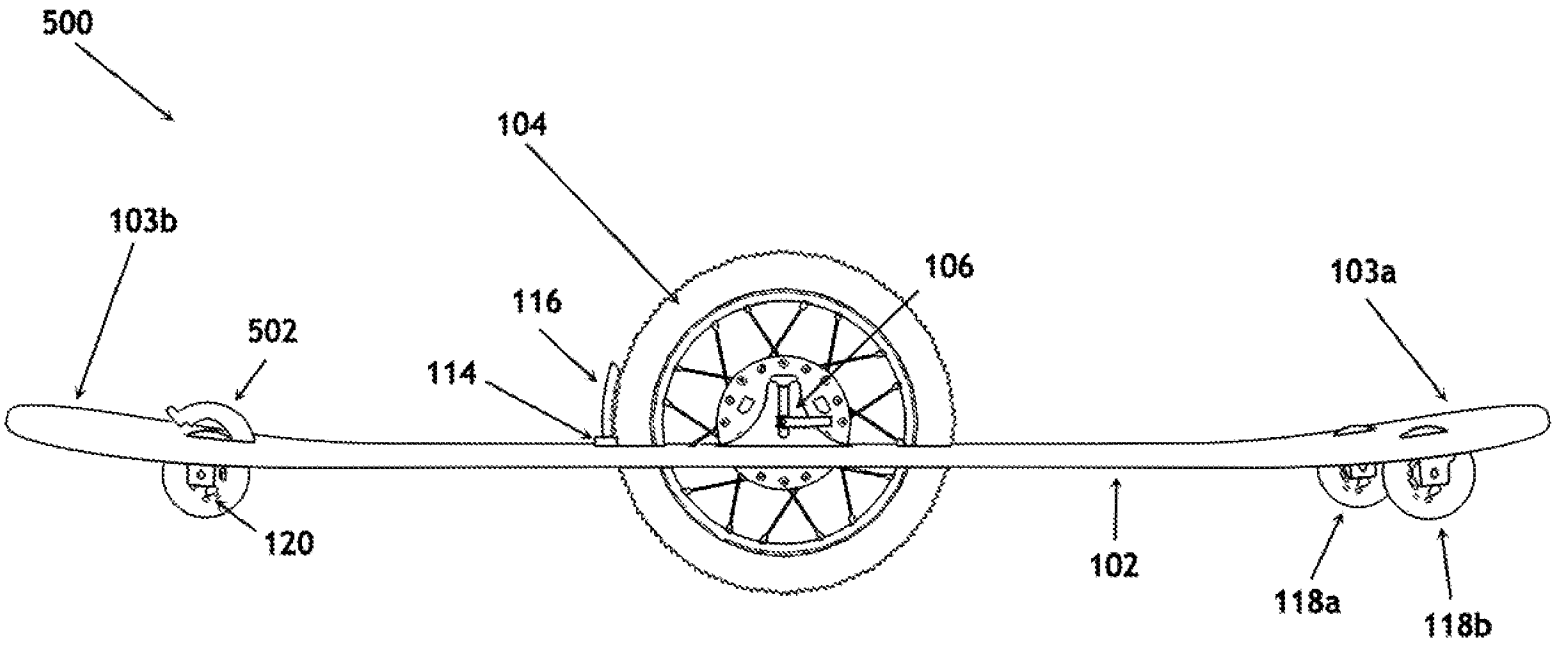
FIG. 5 is a side view of a board apparatus including a rear foot brake mechanism rather than a wheel brake mechanism controlled by a hand brake mechanism according to an alternative embodiment of the present invention.

Alternative brake systems may be added to the board apparatus to replace or augment the wheel brake mechanism 108 on the pivot wheel 104. FIG. 5 is a side view of a board apparatus 500 including a rear foot break mechanism 502 rather than the wheel brake mechanism 108 controlled by a hand brake mechanism 110. As shown, the foot brake mechanism 502 comprises an element that can contact the top of the momentum wheel 120 that protrudes above the hole 126 at the rear end 103*b* of the board 102 and can generate friction between the foot brake mechanism 502 and the momentum wheel 120. The foot brake mechanism 502 may comprise a brake pad and may have a spring that lifts the brake pad so that it does not contact the momentum wheel 120 in a first mode. In a second mode in which a user puts weight on the top of the foot brake mechanism 502 or otherwise pushes on the top of the foot brake mechanism 502, the brake pad within the foot brake mechanism 502 contacts the momentum wheel 120, generating friction and reducing or stopping the rotation of the momentum wheel 120. By reducing or stopping the rotation of the momentum wheel 120, the momentum wheel 120 stops assisting in maintaining momentum of the board apparatus 500 and instead can act as a brake pad for the board apparatus 500 if the user shifts their weight to the rear end 103*b* of the board 102 so that the momentum wheel 120 (now acting as a brake pad) is brought into contact with the ground. Similar foot brake mechanisms could be implemented in some implementations on the top of the momentum wheels 118*a*, 118*b* that extend through the holes 124*a*, 124*b* at the front end 103*a* of the board 102 or on the front or back side of the pivot wheel 104. Further, it should be understood that the foot brake mechanism 502 may be implemented along with the wheel brake mechanism 108 on the pivot wheel 104 within the board apparatus 100. In this case, a user would have two different brake mechanisms available to use to control their speed or to initiate a stop. In some cases, there may be situations in which one of the brake mechanisms 108, 502 may be better to slow or stop the board apparatus 100 and there may be a need to activate both brake mechanisms 108, 502 in some circumstances.

As previously described, in the embodiment of the board apparatus 100 depicted in FIGS. 1A-1D, a user may stand on the top surface of the board 102 with one foot in front of the pivot wheel 104 and one foot behind the pivot wheel 104. In this case, the user can freely adjust the placement of their feet on the top surface of the board 102 which may be required to adjust their weight in operation. In other embodiments, it may be desired to lock down the feet of the user to the board 102 so that they do not slip off the board 102 and also to allow the user to apply more significant angled or sideways pressure on the board using their feet. In particular, locking down the feet of the user may be desired if using the board apparatus 100 in a slalom or other event that would require significant turning or if the board apparatus 100 was being used for jumps or aerial maneuvers where the board apparatus 100 loses contact with the ground.

Figure 8B:
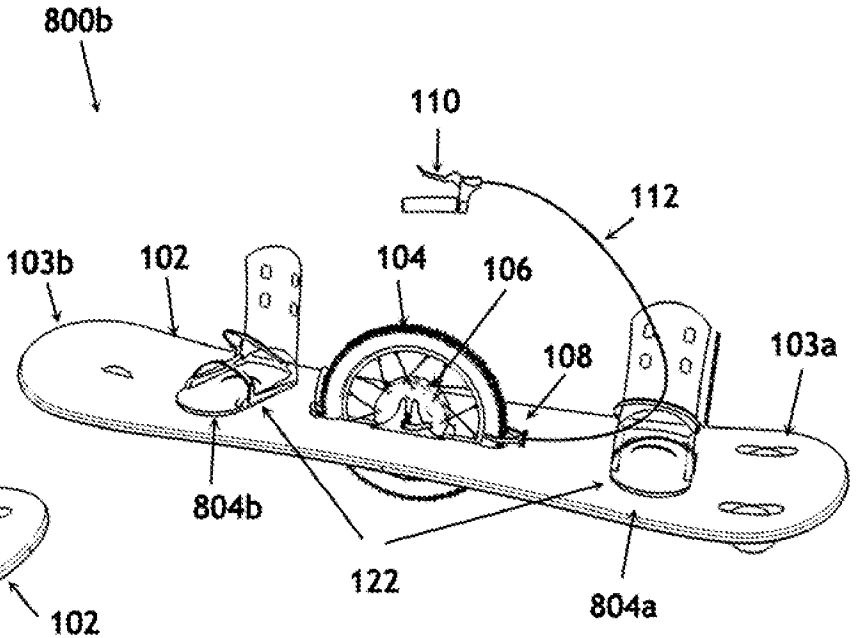
FIGS. 8A and 8B are perspective views of a board apparatus with foot holds and a board apparatus with foot bindings respectively according to embodiments of the present invention.
Figure 8A:
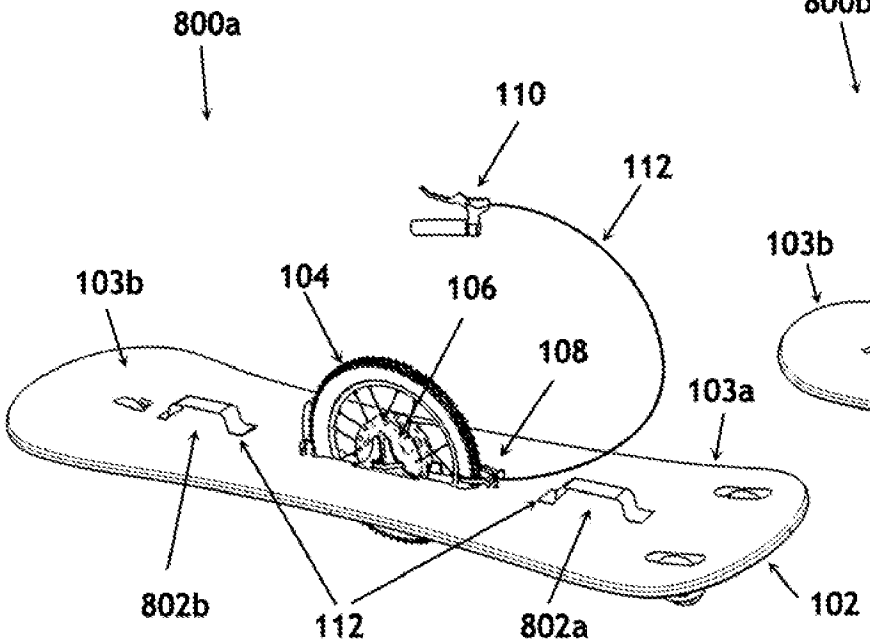

FIG. 8A is a perspective view of board apparatus 800*a* with foot holds 802*a*, 802*b* implemented on the top surface of the board 102. In this case, a first foot hold 802*a* is implemented between the pivot wheel 104 and the front end 103*a* of the board 102 and a second foot hold 802*b* is implemented between the pivot wheel 104 and the rear end 103*b* of the board 102. With these foot holds 802*a*, 802*b*, a user can slide one or both of their feet into locked positions to ride the board apparatus 800*a* or during particular moments in a ride of the board apparatus 800*a*. In some cases, only one of these foot holds 802*a*, 802*b* may be implemented. FIG. 8A is a perspective view of board apparatus 800*b* with foot bindings 804*a*, 804*b* implemented on the top surface of the board 102. In this case, a first foot binding 804*a* is implemented between the pivot wheel 104 and the front end 103*a* of the board 102 and a second foot binding 804*b* is implemented between the pivot wheel 104 and the rear end 103*b* of the board 102. With these foot bindings 804*a*, 804*b*, a user can lock their feet to the board 102 into locked positions to ride the board apparatus 800*b* and the feet will stay connected to the board apparatus 800*b* through the ride and maneuvers undertaken by the user. In some cases, only one of these foot bindings 804*a*, 804*b* may be implemented.

The embodiment of the present invention illustrated in FIGS. 1A-1D depict a pivot wheel 104 that is similar to a bicycle wheel implemented in a substantially central location on the board 102 and at a particular height above the top surface of the board 102. In some implementations of the present invention, the pivot wheel 104 may not be similar to a bicycle wheel, may be adjusted horizontally along the board 102 and/or may be adjusted vertically above the top surface of the board 102. In particular, the pivot wheel 104 may have the spokes removed and replaced by a solid disc element as described with reference to FIG. 9B. Further, the pivot wheel 104 could have a smaller or larger diameter than depicted in FIGS. 1A-1D. The diameter of the pivot wheel 104 has been described as being between 6" and 18" in diameter, though in some implementations, the pivot wheel 104 may be less than 6" or may be greater than 18". A larger pivot wheel would require a wider stance of the user but could potentially allow for a more stable ride. A smaller pivot wheel would bring the board apparatus closer to the ground and could be more affected by debris and obstacles and further would require higher speeds to become stable.

Figure 10:
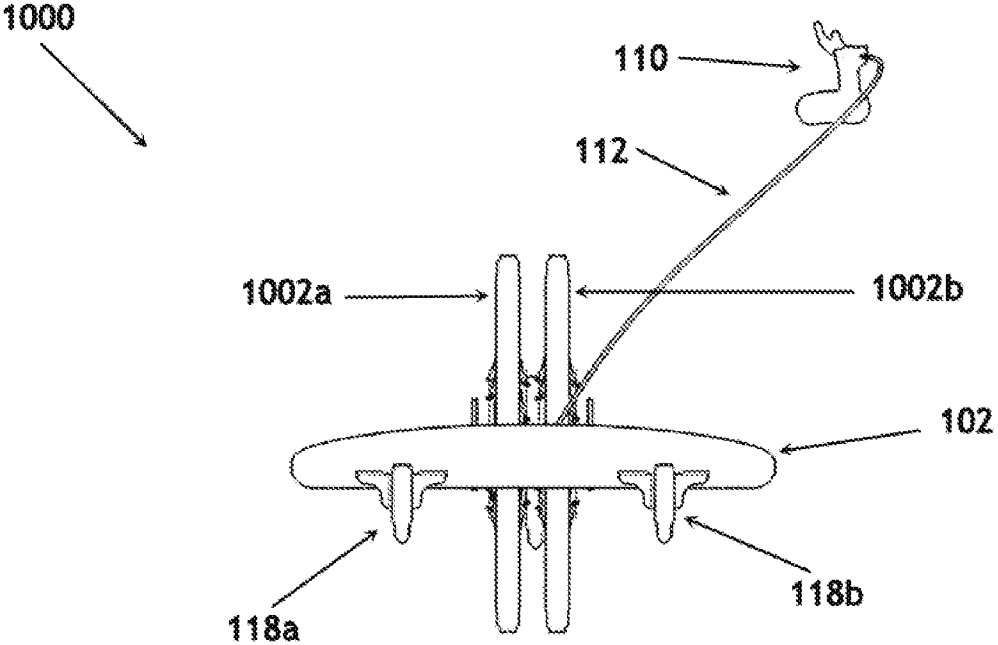
FIG. 10 is a front view of a board apparatus incorporating two parallel pivot wheels according to an alternative embodiment of the present invention.

In other implementations, the pivot wheel 104 may be wider than shown in the embodiment of FIGS. 1A-1D and possibly almost as wide as the board 102 itself or may be narrower than shown. In one embodiment depicted in FIG. 10, a board apparatus 1000 may comprise more than one pivot wheel 1002*a*, 1002*b* in parallel. This would require a wider hole 122 for the pivot wheels 1002*a*, 1002*b* to protrude or two parallel holes in the board 102. In this embodiment, the two pivot wheels 1002*a*, 1002*b* may act together and be controlled by the hand brake mechanism 110 together. In this case, there may be two wheel brake mechanisms 108 implemented or a modified wheel brake mechanism that encompasses both pivot wheels 1002*a*, 1002*b*. In this case, the two pivot wheels 1002*a*, 1002*b* effectively act as a wider pivot wheel system and may be useful for overcoming debris and obstacles. In other implementations, only one of the pivot wheels 1002*a*, 1002*b* may have a wheel brake mechanism 108 enabled and both pivot wheels 1002*a*, 1002*b* may be coupled together and act together or are not coupled together but the braking of one of the pivot wheels 1002*a*, 1002*b* may still slow or stop the board apparatus 1000 sufficiently. In one implementation, braking of the pivot wheels 1002*a*, 1002*b* may be controlled separately with each pivot wheel 1002*a*, 1002*b* having a separate wheel brake mechanism and a separate control mechanism. In this case, if controlled properly, a user may be able to make dramatic turns on one of the pivot wheels 1002*a*, 1002*b*.

Figure 11A:
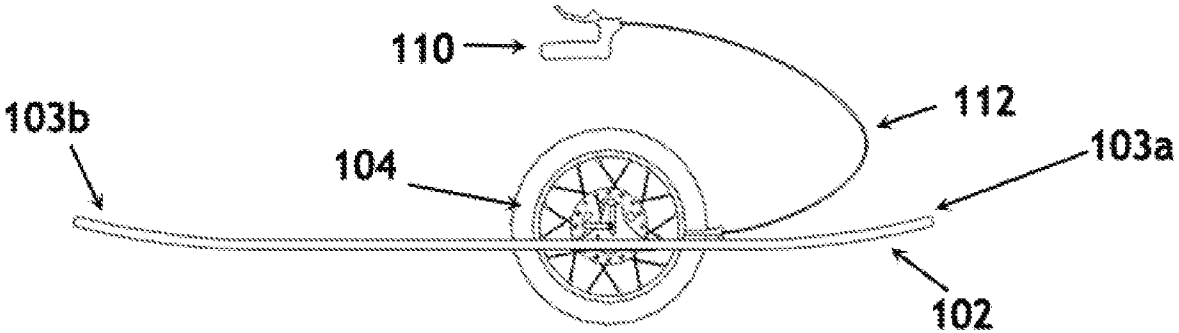
FIGS. 11A, 11B and 11C are side views of first, second and third implementations of board apparatus respectively with varying locations of the pivot wheel.
Figure 11B:
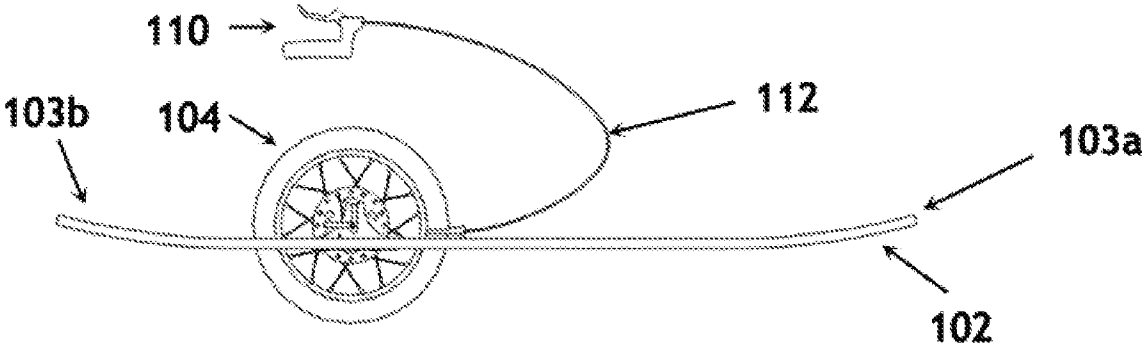
Figure 11C:
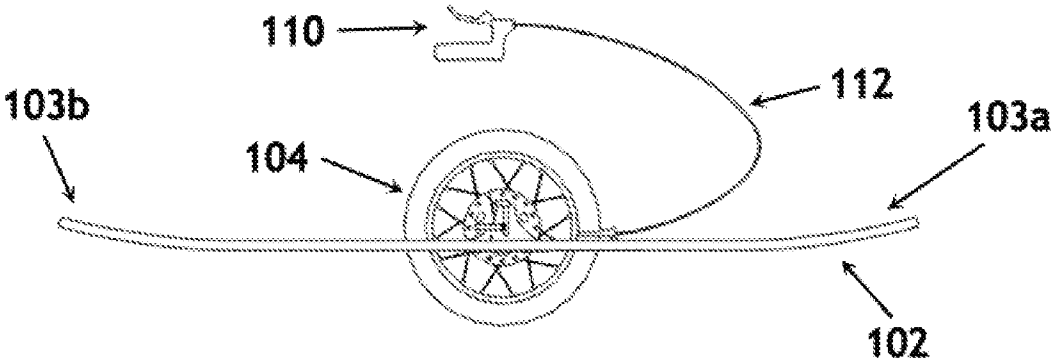

In the embodiment of the board apparatus 100 of FIGS. 1A-1D, the pivot wheel 104 is implemented substantially in the center of the board 102 between the front and rear ends 103*a*, 103*b*. A centrally located pivot wheel 104 can allow the board apparatus to turn from its center point which in turn can reduce side to side forces that would occur directly to the pivot wheel 104 if the pivot wheel 104 was positioned further forward or backward. Effectively, if the pivot wheel is not substantially centered, the weight of the two ends of the board apparatus 100 would not be substantially equal and the lopsided weight could affect the smoothness of performing turns and other changes in direction. Further, shifting the pivot wheel 104 horizontally may force more of the user's weight to one end or the other of the board apparatus 100 which could affect the ride on the board apparatus 100. Despite this, as depicted in FIGS. 11A, 11B and 11C, the pivot wheel 104 may be implemented in varying horizontal locations in some implementations. For simplicity, some components such as the momentum wheels have been removed from the FIGS. 11A, 11B, 11C. FIG. 11A illustrates an implementation of the board apparatus 100 with a substantially central pivot wheel 104 similar to the implementation of FIGS. 1A-1D. FIG. 11B illustrates an implementation of the board apparatus 100 in which the pivot wheel 104 is implemented towards the rear end 103*b* of the board 102. In this implementation, the length of the board 102 between the pivot wheel 104 and the rear end 103*b* of the board is reduced. When traversing a downward incline, this reduced length of the rear portion of the board apparatus 100 could reduce the user pitching forward on the board 102 by forcing more of the user's weight to the back of the board apparatus 100, but it would also limit the user's ability to switch directions on the board (i.e. traverse the incline backwards) or to pivot on the center of the board apparatus 100. FIG. 11C illustrates an implementation of the board apparatus 100 in which the pivot wheel 104 is implemented towards the front end 103*b* of the board 102. In this implementation, the length of the board 102 between the pivot wheel 104 and the front end 103*b* of the board is decreased. This decreased length of the front portion of the board apparatus 100 could force the user to shift their weight forward on the board 102 which normally is not desired while traversing a downward incline. This implementation could be used for more advanced users that may want a different experience or maneuver through a particular set of obstacles.

Figure 12A:
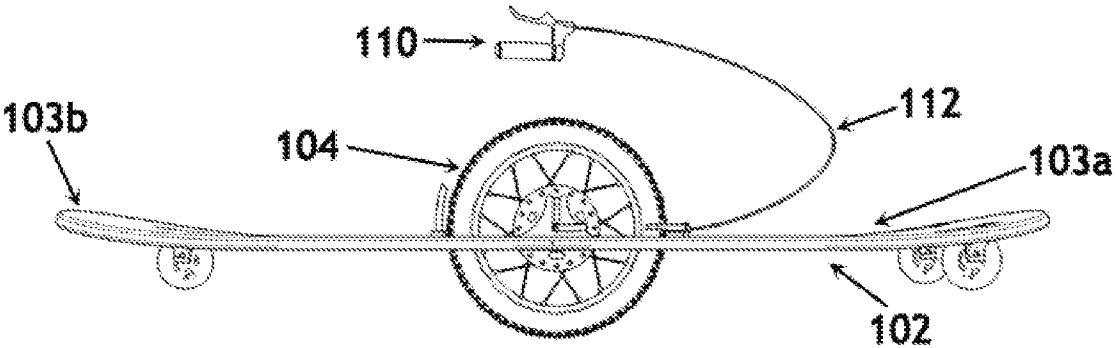
FIGS. 12A, 12B and 12C are side views of first, second and third implementations of board apparatus respectively with varying heights of the pivot wheel.
Figure 12B:
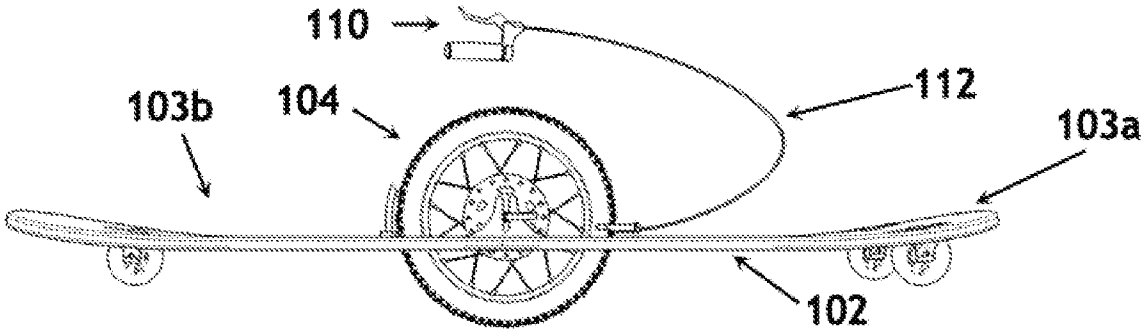
Figure 12C:
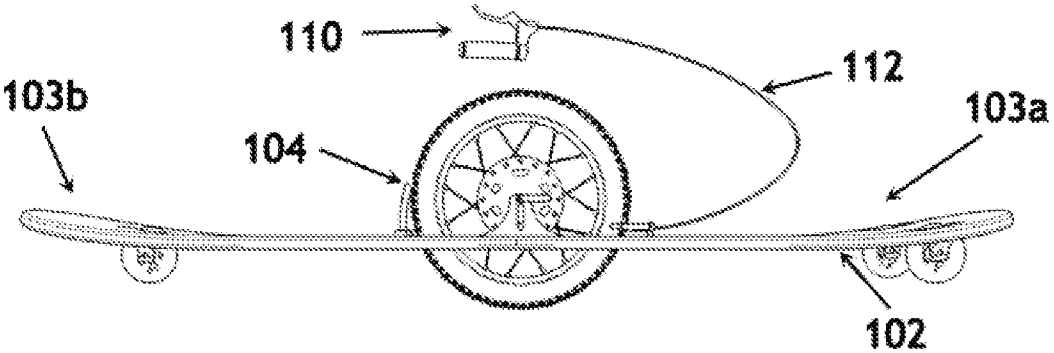

In the embodiment of the board apparatus 100 of FIGS. 1A-1D and FIGS. 2A-2B, the wheel mounting mechanism 106 positions the axle 902 of the pivot wheel 104 vertically above the top surface of the board 102. It should be understood that the axle 902 of the pivot wheel 104 may be positioned at various different vertical distances above the top surface of the board 102 in various implementations. FIGS. 12A, 12B and 12C are side views of first, second and third implementations of board apparatus 100 respectively with varying heights of the pivot wheel 104. FIG. 12A illustrates an implementation of the board apparatus 100 in which the axle 902 of the pivot wheel 104 is closest to the board 102 as mechanically possible in this set-up. In this implementation, a large portion of the pivot wheel 104 extends below the board 102 and therefore, when a user rides the board apparatus 100, the user is higher above the ground. This height is good for overcoming obstacles but may make it difficult to maintain the user's weight over the pivot wheel 104 and avoid having the front end 103*a* or the rear end 103*b* of the board 102 to come into contact with the ground. This height may allow a more experienced user to challenge themselves and benefit from the improved ability to overcome debris and obstacles so that more difficult trails or courses could be traversed using this implementation.

FIG. 12B illustrates an implementation of the board apparatus 100 in which the axle 902 of the pivot wheel 104 is in a middle of the available vertical levels for positioning of the axle 902. In this implementation, less of the pivot wheel 104 extends below the board 102 compared to the positioning of FIG. 12A and therefore, when a user rides the board apparatus 100, the user is relatively lower to the ground. This height may allow the user to more easily maintain their weight on the pivot wheel 104 and prevent the front end 103*a* or the rear end 103*b* of the board 102 from making contact with the ground. The height of the axle 902 may allow the board 102 to be high enough to avoid contact with a reasonable amount of debris and obstacles, though it is less able to overcome debris and obstacles compared to the setup of FIG. 12A.

FIG. 12C illustrates an implementation of the board apparatus 100 in which the axle 902 of the pivot wheel 104 is at the maximum height possible above the top surface of the board 102 as mechanically possible in this set-up. In this implementation, a minimal portion of the pivot wheel 104 extends below the board 102, less than the implementations of FIGS. 12A and 12B. Therefore, when a user rides the board apparatus 100, the user is relatively close to the ground compared to the other implementations. This height may work best for a new user who is getting used to balancing their weight on the pivot wheel 104 and will allow the user to more easily balance on the pivot wheel 104. The height of the axle 902 may allow the board 102 to be high enough to avoid contact with some debris and obstacles such as on a grassy hill, though it is less able to overcome debris and obstacles compared to the setups of FIGS. 12A and 12B.

Although depicted with a wheel mounting mechanism 106 implemented on the top surface of the board 102 that allows for vertical adjustment of the positioning of the axle 902 of the pivot wheel 104, it should be understood that this mechanical system should not limit the scope of the present invention. In particular, a fixed wheel mounting mechanism may be implemented in which the vertical distance between the board 102 and the positioning of the axle 902 of the pivot wheel 104 is fixed and not adjustable by the user. In other embodiments, the wheel mounting mechanism may be implemented in-line with the board 102 and therefore substantially half of the pivot wheel 104 will extend above the board 102 and half the pivot wheel 104 will extend below the board 102. The wheel mounting mechanism may be an integral part of the board 102 and may be formed or manufactured with the board 102. In other embodiments, the wheel mounting mechanism may be implemented below the board 102 and be affixed to the bottom surface of the board 102. In this implementation, the portion of the pivot wheel 104 that protrudes through the hole 122 and extends above the board 102 will be less than the portion of the pivot wheel 104 that extends below the board 102. This will result in the board being higher above the ground and more difficult for the user to balance with their weight on the pivot wheel 104.

Figure 13A:
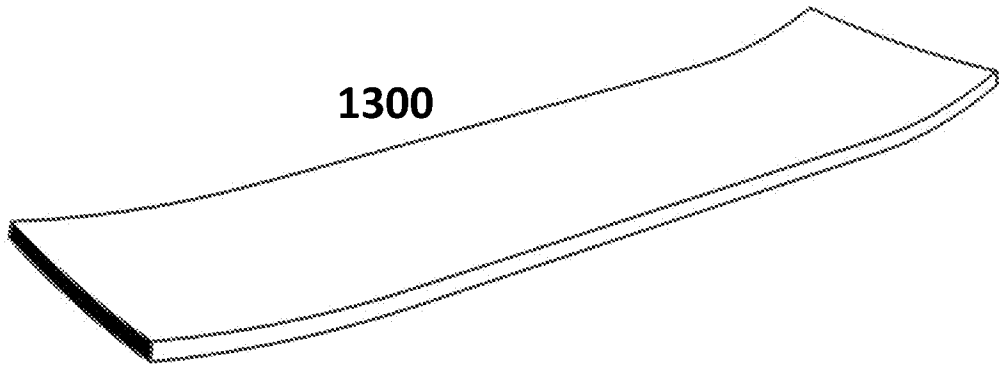
FIGS. 13A, 13B and 13C are a prospective view, a front view and a side view respectively of a board that may be implemented into a board apparatus according to one embodiment of the present invention.
Figure 13B:
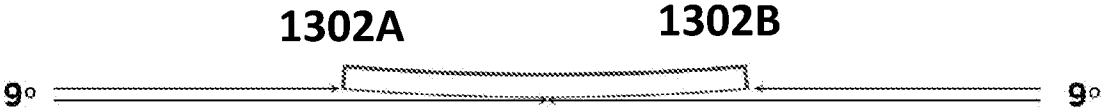
Figure 13C:
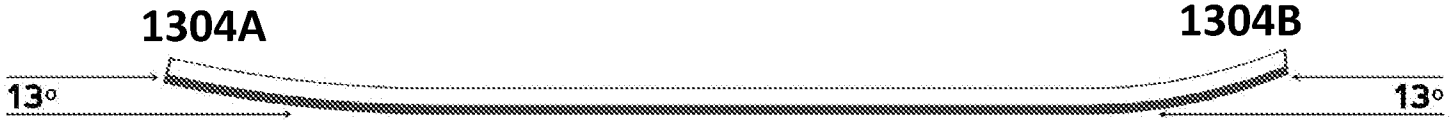

FIGS. 13A, 13B and 13C are a prospective view, a front view and a side view respectively of a board 1300 that may be implemented into a board apparatus according to one embodiment of the present invention. As shown, the board 1300 in this embodiment has a concave upwards curve from widthwise edges 1302A, 1302B and raised edges 1304A, 1304B on the lengthwise ends. The concave upwards curve that extends from the left edge 1302A to the right edge 1302B of the board 1300 can provide additional strength to the board 1300 and reduce the flexibility of the board 1300. In this particular implementation, a curve of 9° is shown between the left edge 1302A and a center of the board 1300 and, similarly, a curve of 9° is shown between the right edge 1302A and a center of the board 1300. It should be understood that other degrees of curvature could be implemented and in some implementations no curvature may be implemented. It should also be understood that a larger degree of curvature may result in a less stable board apparatus as a user may find the board apparatus more difficult to balance from side to side when riding. A minor degree of curvature allows for the improved strength and decreased flexibility of the board 1300 while not significantly affecting the stability of the board apparatus.

The raised edges 1304A, 1304B at the lengthwise ends of the board 1300 can allow for a flat zone to be created for a user's feet and can further provide additional strength to the board 1300 and can further reduce the flexibility of the board 1300. In some cases, the raised edges 1304A, 1304B could be removed or could be replaced by an upward concave curve that fully extends between the two lengthwise ends of the board 1300. In the particular implementation of FIGS. 13A-C, an angle of 13° is shown as the degree of the raised edge 1304A relative to a flat portion of the board 1300 and, similarly, an angle of 13° is shown as the degree of the raised edge 1304B relative to a flat portion of the board 1300. It should be understood that other angles could be implemented, the two lengthwise edges could be raised at different angles and in some implementations lengthwise edges may not be raised at all.

Although various embodiments of the present invention have been described and illustrated, it will be apparent to those skilled in the art that numerous modifications and variations can be made without departing from the scope of the invention, which is defined in the appended claims.

What is claimed is:

1. An apparatus comprising:

an elongated board adapted for a user to stand on, the board having a length with first and second ends and a first hole at a pivot location between the first and second ends and one or more second holes between the first hole and the first end;

a pivot wheel coupled to the board and protruding through the first hole such that the pivot wheel is adapted to rotate in parallel with the length of the board, a first portion of the pivot wheel being below the board and a second portion of the pivot wheel being above the board; wherein the pivot wheel comprises a central axle;

a wheel mounting apparatus coupled to the board adjacent to the first hole at the pivot location, the wheel mounting apparatus being adapted to secure the axle of the pivot wheel a first distance above a top surface of the board, whereby the first portion of the pivot wheel below the board is less than the second portion of the pivot wheel above the board; and one or more first wheels coupled to a bottom surface of the board between the pivot wheel and the first end of the board, each of the first wheels implemented below one of the second holes in the board such that a portion of each of the first wheels protrude through a corresponding one of the second holes in the board; wherein the first wheels have substantially smaller diameters than the pivot wheel.

2. The apparatus according to claim 1, wherein the board further has one or more third holes between the first hole and the second end; and the apparatus further comprises one or more second wheels coupled to a bottom surface of the board between the pivot wheel and the second end of the board, each second wheel implemented below one of the third holes in the board such that a portion of each of the second wheels protrude through a corresponding one of the third holes in the board; wherein the second wheels have substantially smaller diameters than the pivot wheel.

3. The apparatus according to claim 1, wherein the first hole is substantially centered between the first and second ends.

4. The apparatus according to claim 1, wherein the wheel mounting apparatus is adapted to secure the axle of the pivot wheel the first distance above the top surface of the board in a first configuration and to secure the axle of the pivot wheel a second distance above the top surface of the board different than the first distance in a second configuration.

5. The apparatus according to claim 1 further comprising a brake apparatus coupled to the pivot wheel.

6. The apparatus according to claim 5 further comprising a hand brake apparatus connected to the brake apparatus by a cable for controlling the brake apparatus; wherein the hand brake apparatus is adapted to engage the brake apparatus to increase friction on the pivot wheel if in a first mode and to disengage the brake apparatus to decrease friction on the pivot wheel if in a second mode.

7. The apparatus according to claim 1, wherein a first portion of each of the first wheels is below the board and a second portion of each of the first wheels is above the board; wherein the first and second wheels are coupled to the bottom surface of the board such that, for each of the first and second wheels, the first portion below the board is greater than the second portion above the board.

8. The apparatus according to claim 5, wherein the brake apparatus is coupled to the second portion of the pivot wheel above the board.

9. An apparatus comprising:

an elongated board adapted for a user to stand on, the board having a length with first and second ends and a hole at a pivot location between the first and second ends;

a pivot wheel coupled to the board and protruding through the hole such that the pivot wheel is adapted to rotate in parallel with the length of the board, a first portion of the pivot wheel being below the board and a second portion of the pivot wheel being above the board, wherein the pivot wheel comprises a central axis;

one or more first wheels coupled to a bottom surface of the board between the pivot wheel and the first end of the board and one or more second wheels coupled to the bottom surface of the board between the pivot wheel and the second end of the board, wherein both the first and second wheels have substantially smaller diameters than the pivot wheel; and a wheel mounting apparatus coupled to the board adjacent to the hole at the pivot location, the wheel mounting apparatus being adapted to secure the axle of the pivot wheel a first distance above a top surface of the board, whereby the first portion of the pivot wheel below the board is less than the second portion of the pivot wheel above the board.

10. The apparatus according to claim 9 further comprising a brake apparatus coupled to the pivot wheel.

11. The apparatus according to claim 10 further comprising a hand brake apparatus connected to the brake apparatus by a cable for controlling the brake apparatus; wherein the hand brake apparatus is adapted to engage the brake apparatus to increase friction on the pivot wheel if in a first mode and to disengage the brake apparatus to decrease friction on the pivot wheel if in a second mode.

12. The apparatus according to claim 9, wherein a first portion of each of the first wheels is below the board and a second portion of each of the first wheels is above the board.

13. The apparatus according to claim 12, wherein the first wheels are coupled to the bottom surface of the board such that, for each of the first wheels, the first portion below the board is greater than the second portion above the board.

14. The apparatus according to claim 12, wherein a first portion of each of the second wheels is below the board and a second portion of each of the second wheels is above the board.

15. The apparatus according to claim 14, wherein the first and second wheels are coupled to the bottom surface of the board such that, for each of the first and second wheels, the first portion below the board is greater than the second portion above the board.

16. The apparatus according to claim 9, wherein the wheel mounting apparatus is adapted to secure the axle of the pivot wheel the first distance above the top surface of the board in a first configuration and to secure the axle of the pivot wheel a second distance above the top surface of the board different than the first distance in a second configuration.

17. The apparatus according to claim 9, wherein the first hole is substantially centered between the first and second ends.

18. The apparatus according to claim 10, wherein the brake apparatus is coupled to the second portion of the pivot wheel above the board.

* * * * *